US010470976B2

(12) United States Patent
Warden et al.

(10) Patent No.: US 10,470,976 B2
(45) Date of Patent: Nov. 12, 2019

(54) MEDICATION PACKAGING AND DOSE REGIMEN SYSTEM

(71) Applicant: MYLAN INC, Canonsburg, PA (US)

(72) Inventors: Jeffrey Warden, Bala Cynwyd, PA (US); Eric Richardson, Cave Creek, AZ (US); JoAnna Terhune, Pittsburgh, PA (US); Michael Scouvart, Venetia, PA (US); Anthony R Mauro, Washington, PA (US)

(73) Assignee: Mylan Inc., Canonsburg, PA (US)

( * ) Notice: Subject to any disclaimer, the term of this patent is extended or adjusted under 35 U.S.C. 154(b) by 0 days.

(21) Appl. No.: 15/757,175

(22) PCT Filed: Sep. 1, 2016

(86) PCT No.: PCT/US2016/049887
§ 371 (c)(1),
(2) Date: Mar. 2, 2018

(87) PCT Pub. No.: WO2017/040773
PCT Pub. Date: Mar. 9, 2017

(65) Prior Publication Data

US 2018/0250196 A1 Sep. 6, 2018

Related U.S. Application Data

(60) Provisional application No. 62/213,226, filed on Sep. 2, 2015.

(51) Int. Cl.

| | |
|---|---|
| ***B65D 41/04*** | (2006.01) |
| ***B65D 51/24*** | (2006.01) |
| ***B65D 50/04*** | (2006.01) |
| ***A61J 7/04*** | (2006.01) |
| ***A61J 1/03*** | (2006.01) |

(Continued)

(52) U.S. Cl.
CPC . *A61J 7/04* (2013.01); *A61J 1/03* (2013.01); *A61J 1/1418* (2015.05); *A61J 1/18* (2013.01); *B65D 41/04* (2013.01); *B65D 50/04* (2013.01); *B65D 51/245* (2013.01); *A61J 2205/20* (2013.01); *A61J 2205/30* (2013.01); *A61J 2205/50* (2013.01)

(58) Field of Classification Search
CPC .... A61J 7/04; A61J 1/1418; A61J 1/03; A61J 1/18; A61J 2205/20; A61J 2205/30; A61J 2205/50; B65D 41/04; B65D 50/04; B65D 51/245
USPC ..... 215/230, 220, 208
See application file for complete search history.

(56) References Cited

U.S. PATENT DOCUMENTS 3,968,871 A * 7/1976 Briscoe ..... A61J 1/03 206/1.5
5,082,129 A * 1/1992 Kramer ..... B65D 50/046 215/216

(Continued)

*Primary Examiner* — J. Gregory Pickett
*Assistant Examiner* — Niki M Eloshway

(57) ABSTRACT

Medication packaging includes a body defining a cavity for disposal of medication. A closure member is disposed with the body. The closure member includes an advancement mechanism and a window that displays indicia of a medication dosage regimen. The closure member is rotatable between a medication accessible configuration and a closed configuration that includes a sealing position and an advance position to incrementally advance the indicia. Systems and methods of use are disclosed.

19 Claims, 35 Drawing Sheets

(51) Int. Cl.
*A61J 1/18* (2006.01)
*A61J 1/14* (2006.01)

(56) References Cited

U.S. PATENT DOCUMENTS 5,184,739 A * 2/1993 Kusz ..... A61J 7/04 116/308
5,678,712 A * 10/1997 Rios ..... B65D 50/041 116/308
5,720,392 A * 2/1998 Price ..... A61J 7/04 116/308
5,765,706 A * 6/1998 Barker ..... A61J 7/04 116/309
5,823,346 A * 10/1998 Weiner ..... A61J 7/04 206/534
6,059,133 A * 5/2000 Lai ..... B65D 51/245 116/309
6,089,180 A * 7/2000 Nichols, Jr. ..... G09F 11/23 116/308
8,371,464 B2 * 2/2013 Rachuk ..... A61M 1/0001 206/459.1
2006/0124501 A1 * 6/2006 McNeely ..... A61J 7/04 206/534
2006/0180566 A1 * 8/2006 Mataya ..... A61J 7/04 215/230
2011/0184415 A1 * 7/2011 Anderson ..... A61B 17/7059 606/70
2013/0292354 A1 * 11/2013 Xu ..... A61J 7/04 215/230
2014/0008319 A1 * 1/2014 Buxton-Dakides ..... A61J 1/03 215/230
2014/0332494 A1 * 11/2014 Balakier ..... A61J 7/04 215/365
2015/0008152 A1 * 1/2015 Xu ..... A61J 1/03 206/538
2015/0068947 A1 * 3/2015 Balakier ..... A61J 7/04 206/534
2016/0106626 A1 * 4/2016 Barajas ..... A61J 1/03 206/534
2016/0120760 A1 * 5/2016 Nazginov ..... A61J 7/0481 215/230
2016/0125771 A1 * 5/2016 Nazginov ..... A61J 1/03 116/201
2017/0135906 A1 * 5/2017 Berman ..... A61J 7/0076
2017/0225834 A1 * 8/2017 Peng ..... B65D 23/14
2018/0178955 A1 * 6/2018 West ..... B65D 51/245

* cited by examiner

MEDICATION PACKAGING AND DOSE REGIMEN SYSTEM

This application is a U.S. National Stage application under 35 U.S.C. § 371 of International Patent Application No. PCT/US16/49887, filed Sep. 1, 2016, which claims the benefits of U.S. Provisional Patent Application No. 62/213,226 filed Sep. 2, 2015, the contents of which being hereby incorporated herein in its entirety by reference.

TECHNICAL FIELD

The present disclosure generally relates to medicament packaging and more particularly to a dispensing device and system that provides a medication regimen and/or tamper resistance and a method for treatment of a medical condition.

BACKGROUND

Retail customers and/or patients can be engaged in a medical therapy, which may include diet, exercise and/or a prescription and/or a non-prescription medication dosing regimen, which may be employed to treat an illness. In some cases, hospitalized patients are often discharged and instructed by one or more medical practitioners to comply with a medical therapy.

Such medication dosing regimen can include one or a plurality of medications administered over a regimen, which may include one or more medications. The medication dosing regimen can require administration of medications simultaneously, at different times and/or according to days of a week or time of day. Such medication regimens may be administered in addition to existing medication regimens that a user may take for nutritional, therapeutic and/or illness treatment.

Such medication regimens, however, often suffer from poor patient compliance. In fact, many patients fail to comply with their medication regimens. In some cases, life-style related medications may also suffer from poor user compliance. Factors that contribute to non-compliance may include complexity of medication regimen, patient failure in filling prescriptions, incorrect order and/or prescription, cost, adverse side effects, patient reluctance, lack of motivation, non-reconciliation with existing medication and/or patient physiological issues.

Various medications of a medication regimen can be dispensed from a medication container such as single dose and/or multiple dose blister packaging to a user with or without tamper resistance. Multiple dose blister packaging can dispense a single medication according to a regimen including day, e.g., Monday, Tuesday, etc. and/or time of day. This disclosure describes an improvement over these prior technologies.

SUMMARY

In one embodiment, medication packaging is provided. The medication packaging includes a body defining a cavity for disposal of medication. A closure member is disposed with the body. The closure member includes an advancement mechanism and a window that displays indicia of a medication dosage regimen. The closure member is rotatable between a medication accessible configuration and a closed configuration that includes a sealing position and an advance position to incrementally advance the indicia. Systems and methods of use are disclosed.

BRIEF DESCRIPTION OF THE DRAWINGS

The present disclosure will become more readily apparent from the specific description accompanied by the following drawings, in which.

DETAILED DESCRIPTION

Figure 1:
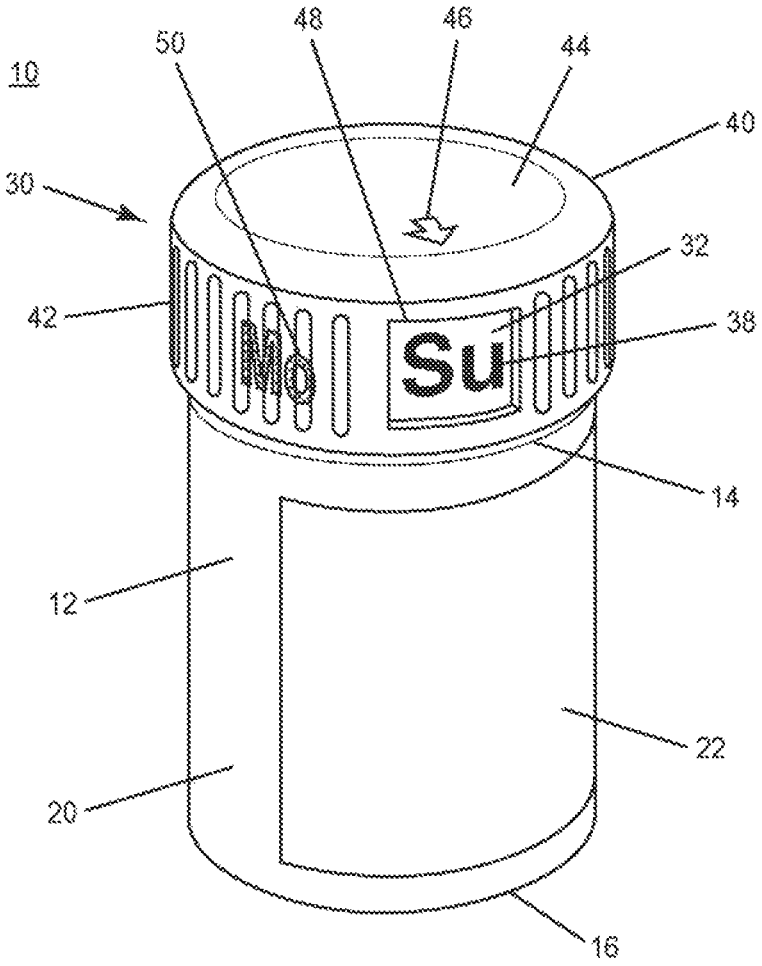
FIG. 1 is a perspective view of components of one embodiment of a system in accordance with the principles of the present disclosure.

The exemplary embodiments of a medicament packaging system and related methods of use disclosed are discussed in terms of dispensing devices for the treatment of various diseases, illness and/or ailments and more particularly, in terms of a medicament dispensing device and system that provides a medication regimen and/or tamper resistance and a method for treatment of a medical condition. In some embodiments, the present system is employed with a method for distribution of medication packaging to a patient for treatment of one or more diseases, illness and/or ailments. In some embodiments, the present system is employed with a method such that a patient is discharged from a health care facility, for example, short term discharge and/or long term discharge.

In some embodiments, the present system comprises a medicament dispensing system and methods of use for storage, transportation and discharge of medications for the treatment of a medical condition. In one embodiment, the systems and methods of the present disclosure are employed to aid a person with a medical condition requiring the administration of multiple pills, doses, or schedules. In one embodiment, the systems and methods of the present disclosure include a medicament dispensing device that provides child-resistance while being easily accessed by an adult. In some embodiments, the present system comprises a medicament dispensing system and methods of use for storage, transportation and discharge of medications including those for treating illnesses, such as, for example, hypothyroidism, myocardial infarction, elevated blood pressure, dyslipidemia (high cholesterol), diabetes, metabolic syndrome, heart failure, pneumonia, cardiac deficiencies, arthritis, illnesses in which pain is part of an on-going treatment plan, and/or life-style related medications such as, for example, birth control pills, hormone replacement pills and nutritional supplements, such as, for example, neutraceuticals, for example, having vitamin A, D, and E with a calcium supplement.

In some embodiments, the present system includes a medicament dispensing system that includes a container body having a threaded screw top to engage a child-resistant lid. In one embodiment, the container body has a neck portion having threads to engage the lid. In some embodiments, the medicament dispensing system is partially or entirely filled and built by a pharmacist. In some embodiments, the medicament dispensing system comprises a resilient material. In some embodiments, the medicament dispensing system provides child-resistance and is easily accessible by an adult. In various embodiments, a method for accessing the medicaments held within the medicament dispensing system is provided. The method requires consecutive and/or simultaneous motions difficult for children to perform and simple for an adult to perform.

In some embodiments, the present system includes a medicament dispensing system comprising a semi-automatic indicia changing system. In some embodiments, the medicament dispensing system includes a cap having reminders in the form of indicia on a sidewall. In some embodiments, the indicia may be in the form of the day of the week. In some embodiments, the medicament dispensing system includes a window, such as, for example, clear, transparent, shaded and/or frosted window member, which shows the indicia through the window. In some embodiments, the window member is colored translucent blue. In some embodiments, the cap is tightened on a bottle until an audible click is heard and then the window member of the cap is rotated further until a second click is heard. In some embodiments, the window member can only be rotated in one direction. In some embodiments, the cap includes an advancement mechanism to move the window member relative to the indicia. In some embodiments, the cap includes a threaded insert. In some embodiments, the cap includes a wafer seal.

In some embodiments, the present system includes a medicament dispensing system comprising a window, such as, for example, a clear cap mounted over an opaque inner cap. In some embodiments, the inner cap displays the days of the week around its perimeter. In some embodiments, the clear cap spins or locks in position relative to the inner cap. In some embodiments, indicia in the form of days of the week are printed onto a circular ring. In some embodiments, the indicia of the circular ring are visible from the side of the cap. In some embodiments, the indicia are advanced while tightening the cap on a threaded bottle. In some embodiments, the cap uses a two click method in which the first click seals the cap to the bottle and the second click advances the clear cap.

In some embodiments, the present system includes a medicament dispensing system comprising gripping portions extending from the cap to aid a user in removing the cap. In some embodiments, the cap includes a window and indicia on a top surface. In some embodiments, the cap includes a button on the side to advance indicia. In some embodiments, the indicia comprise a soft thermoplastic elastomeric material that is compressible and is biased to a rest configuration when not being compressed. In some embodiments, one push of the button moves the indicia by one increment. In some embodiments, the indicia can be advanced in only one direction. In some embodiments, the gripping portions occupy unused space between bottles when the bottles are stored next to one another on a table top. In some embodiments, the gripping portions are configured to be as large as possible without increasing the distance between bottles positioned adjacent to one another on a table top. In some embodiments, the medicament dispensing system includes a cap having a button positioned on the top of the cap.

In some embodiments, the present system includes a medication dispensing system comprising a manual advancement mechanism for indicia. In some embodiments, pressing a button on the side of the cap advances the indicia by one increment. In some embodiments, the button is hidden behind a flexible plastic. In some embodiments, the button operates to advance the indicia regardless of whether the cap is installed on a medicine container. In some embodiments, the shape of the cap is designed to provide greater surface area and leverage than a circular cap. In some embodiments, the cap is removed from a medicine container by pushing down and rotating. In some embodiments, the cap is tightened onto a medicine container by rotating clockwise along threads on the medicine container.

In some embodiments, the present system includes a medication dispensing system comprising a manual advancement mechanism for indicia. In some embodiments, the button is on the top of the cap. In some embodiments, the button is hidden behind a flexible plastic member. In some embodiments, the button operates to advance the indicia independent of whether the cap is installed on a medicine container. In some embodiments, the cap is removed from a medicine container by pushing down and rotating the cap. In some embodiments, the cap is tightened onto a bottle by rotating clockwise along threads on the medicine container.

In some embodiments, the present system includes a medication dispensing system having an outer cap, an inner cap and a rotatable ring. In some embodiments, the outer cap includes at least one rib configured as a stop. In some embodiments, the outer cap includes a tooth configured to engage a tooth disposed on the rotatable ring. In some embodiments, the medication dispensing system includes a molded-in cantilever spring configured to facilitate axial motion and provide an anti-back out mechanism. In some embodiments, the outer cap and the ring are configured to rotate in unison and/or simultaneously during a clockwise rotation. In some embodiments, as the ring rotates, the cantilever disposed on the ring flexes over a tooth disposed on the inner cap.

In some embodiments, the present system includes a medication dispensing system configured for clockwise rotation such that the outer cap moves to advance indicia. In some embodiments, the medication dispensing system includes a seal, a threaded insert, a decoupling feature and an internal dial snap configured to retain the outer cap, an indicator ring and an inner cap as a subassembly that can translate up and down.

In some embodiments, the present system includes a medication dispensing system having an upper cap with an aperture for day display. In some embodiments, the present system includes a two-shot molded flexible center button membrane section. In some embodiments, the medication dispensing system includes a rigid button. In some embodiments, the medication dispensing system includes an indicator ring having inner teeth for advancement and outer teeth for registration and anti back-up. In some embodiments, the medication dispensing system includes an advancer, such as, for example, a pawl with an off-center pivot location. In some embodiments, the pawl includes a centrally located ramp or cam and an inserted molded wire spring. In some embodiments, the medication dispensing system includes a lower cap configured to encase a threaded insert and an induction seal that provides a platform for the advancement mechanism.

In some embodiments, the present system includes a medication dispensing system having a rigid button with a protrusion, such as, for example an arcuate post. In some embodiments, the post includes a leading edge of the post that applies a downward force to the pawl. In some embodiments, the off-center pivot of the pawl creates an advantageous mechanical relationship, such as, for example, a 0.090 inch downward displacement that creates a 0.160 inch displacement of the pawl tip. In some embodiments, a downward force on a ramp of the pawl provides a horizontal component of force that creates rotational motion of the components. In some embodiments, the pawl tip drives an indicator ring to the next position. In some embodiments, a wire spring returns the advancer to a home position.

In some embodiments, the present system includes a medication dispensing system having a flexible beam configured to register the indicator ring and provide an anti back-up mechanism. In some embodiments, the indicator ring includes an anti back-up feature. In some embodiments, the present system includes a medication dispensing system having a lower cap and an existing threaded insert snap-fits into the lower cap. In some embodiments, the lower cap includes an internal thread for attachment to a bottle. In some embodiments, an induction seal is inserted into the threaded insert. In some embodiments, the induction seal is sealed to the top rim of the bottle.

In some embodiments, the present system includes a medication dispensing system having child resistant features. In some embodiments, a downward force is required to engage these features and remove the cap. In some embodiments, the child resistant features include a ramp for cap removal and a vertical wall for tightening. In some embodiments, the child resistant features are engaged and a gap allows for vertical movement of the lower cap relative to the threaded insert, such as, for example, to allow slippage to occur if downward force is not applied.

In some embodiments, the present system includes a medication dispensing system having an anti back-up feature. In some embodiments, the pawl includes a pivot point. In some embodiments, a post on the button pushes a ramp on the pawl to achieve rotational motion. In some embodiments, the pawl includes a return spring. In some embodiments, the indicator ring includes anti back-up teeth and advancement teeth.

In some embodiments, the present system includes a medication dispensing system having a moveable stop. In some embodiments, the medication dispensing system includes two fixed stops. In some embodiments, the medication dispensing system includes a first ramp and a second ramp. In some embodiments, the medication dispensing system includes an audible click feature and/or a tactile click feature. In some embodiments, the cap rotates counter clockwise and the click feature bends inward. In some embodiments, the click feature flexes back outward and falls into a home position. In some embodiments, the cap is placed on the bottle and rotated clockwise causing the click feature to translate over the first ramp and into a recessed area. In some embodiments, the cap is further rotated clockwise to advance the day.

The present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. In some embodiments, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

As used in the specification and including the appended claims, "treating" or "treatment" of a disease or condition may include administering one or more medications to a patient (human or other mammal). Alleviation can occur prior to signs or symptoms of the disease or condition appearing, as well as after their appearance. Thus, treating or treatment includes preventing or prevention of disease or undesirable condition (e.g., preventing the disease from occurring in a patient, who may be predisposed to the disease but has not yet been diagnosed as having it). In addition, treating or treatment does not require complete alleviation of signs or symptoms, does not require a cure, and specifically includes procedures that have only a marginal effect on the patient. Treatment can include inhibiting the disease, e.g., arresting its development, or relieving the disease, e.g., causing regression of the disease. For example, treatment includes, but is not limited to, reducing acute or chronic inflammation, inducing an anti-platelet effect, reducing hypertension, and lowering cholesterol.

In some embodiments, a biologically-active substance includes any substance or substances comprising a medicament, medication or drug including an active therapeutic substance, metabolite, hormone, steroid, vitamin, fatty acid, amino acid, sugar, carbohydrate, polypeptide or mineral. In some embodiments, a biologically-active substance includes any substance used for treatment, prevention, diagnosis, cure or mitigation of disease or illness. In some embodiments, a biologically-active substance includes any substance that affects anatomical structure or physiological function. In some embodiments, a biologically-active substance includes any substance that alters the impact of external influences on an animal, or metabolite thereof. In some embodiments, a complex dosing regimen includes a systematic administration of multiple dosage units at designated times during the day. In some embodiments, a dose includes each individual release of substance into body tissue.

The following discussion includes a description of a medicament dispensing system including a medicament dispensing container, related components and methods of employing the medicament dispensing system. Alternate embodiments are also disclosed. Reference is made in detail to the exemplary embodiments of the present disclosure, which are illustrated in the accompanying figures. Turning to FIGS. 1-5, there are illustrated components of a medicament dispensing system 10.

The components of medicament dispensing system 10, individually or collectively, can be fabricated from materials suitable for storage and dispensing of medication. In some embodiments, such materials include metals, ceramics, synthetic polymers such as thermoplastics, semi-rigid and rigid materials, elastomers, fabric and/or their composites. Various components of medicament dispensing system 10 may have material composites, including the above materials, to achieve various desired characteristics such as strength, rigidity, elasticity, compliance, and durability. The components of medicament dispensing system 10, individually or collectively, may also be fabricated from a heterogeneous material such as a combination of two or more of the above-described materials. The components of medicament dispensing system 10 may be monolithically formed, integrally connected or include fastening elements and/or instruments, as described herein.

In some embodiments, as shown in FIGS. 1-5, medicament dispensing system 10 includes a medication container, such as, for example, medication bottle 12. Bottle 12 includes an opening at a top end 14 and an oppositely positioned base 16. In some embodiments, bottle 12 includes a circular cross-section. In some embodiments, bottle 12 may include cross-section shapes, such as, for example, round, partially cylindrical, oval, rectangular, polygonal, irregular, tapered, offset, staggered, uniform and non-uniform.

Bottle 12 defines an inner cavity 18 configured to receive medications, such as, for example, dosage units as part of a medication dosage regimen. In some embodiments, cavity 18 is divided into a number of compartments by partitions. For example, cavity 18 may be divided into two, three, four, or more compartments that are radially arrayed in cavity 18. In some embodiments, the compartments can be variously and/or differently sized and configured for disposal of one or more medications. In some embodiments, bottle 12 is transparent or semi-transparent to allow a patient to monitor the remaining amount of medications in cavity 18.

Bottle 12 includes a surface 20 that is configured to be handled by a patient to access the medications stored therein. In some embodiments, surface 20 may have alternate surface configurations, such as, for example, rough, arcuate, undulating, mesh, porous, semi-porous, dimpled and/or textured to facilitate gripping by a patient. In some embodiments, surface 20 includes ergonomic features, such as, for example, rubberized inserts or grooves to conform to a user's grip. In some embodiments, bottle 12 may comprise indicia on surface 20 in the form of a label 22. In some embodiments, label 22 provides the time and order in which the medications are to be taken by the patient. In one embodiment, bottle 12 is labeled to indicate the day of the dosage regimen the medication should be taken. Label 22 may include graphics to indicate the time of day the medication should be taken. Label 22 may indicate the name and/or nature of the medication held in cavity 18. Label 22 may include a list of possible side effects of the medication held in cavity 18. Label 22 may provide instructions on how long a patient should take the medication held in cavity 18. In some embodiments, label 22 may provide color coding to differentiate the medications held within the various compartments of cavity 18. In various embodiments, the indicia of label 22 are screen printed on bottle 12. In some embodiments, the indicia may be hand written. In some embodiments, label 20 may comprise a sticker containing the indicia to be adhered to a portion of bottle 12.

Bottle 12 includes a neck portion 24 positioned opposite base 16. Neck portion 24 extends from bottle 12 and includes an outer surface 26 having threads 28. In some embodiments, threads 28 may include a single thread turn or a plurality of discrete threads. In some embodiments, threads 28 comprise child-resistant features, such as, for example, a gap in threads 28 to correspond with a tab in the threads of a lid, as discussed herein.

In some embodiments, medicament dispensing system 10 includes a closure member, such as, for example, a lid 30. In some embodiments, lid 30 includes an indicator cap 32 having indicia 38. Cap 32 includes a circumferential sidewall 34 extending from the periphery of a top surface 36. Cap 32 includes an inner surface sized to receive a threaded insert 60 and/or a sealing gasket 70, as discussed herein. Cap 32 includes an outer surface configured to receive a clear outer cap 40 having a window for viewing indicia 38. In some embodiments, indicia 38 are printed onto an outer circumferential sidewall of cap 32. In some embodiments, indicia 38 may include information presented on a top surface of cap 32. In other embodiments, indicia 38 are positioned on a surface that extends diagonally between top surface 36 and sidewall 34. In some embodiments, indicia 38 are presented to represent days of the week and are radially arrayed and spaced evenly about the sidewall of cap 32. In some embodiments, indicia 38 are presented to represent times of the day in which a medication is to be taken by a user. In some embodiments, indicia 38 are presented as a combination of time and day in which a medication is to be taken by a user.

Lid 30 includes cap 40 configured to aid a user in maintaining compliance with a complex dosage regimen. Cap 40 includes a circumferential sidewall 42 extending from the periphery of a top surface 44. In some embodiments, surface 44 is solid and continuous. In some embodiments, surface 44 includes a central aperture such that cap 40 is substantially ring shaped and configured to fit around sidewall 34 of cap 32. Cap 40 includes an inner diameter that is configured to fit snugly over cap 32. In some embodiments, cap 40 attaches to cap 32 by a pressure fit or a friction fit. In some embodiments, cap 40 includes one or more flexible tabs at the bottom of sidewall 42 to latch to sidewall 34 of cap 32.

Figure 2:
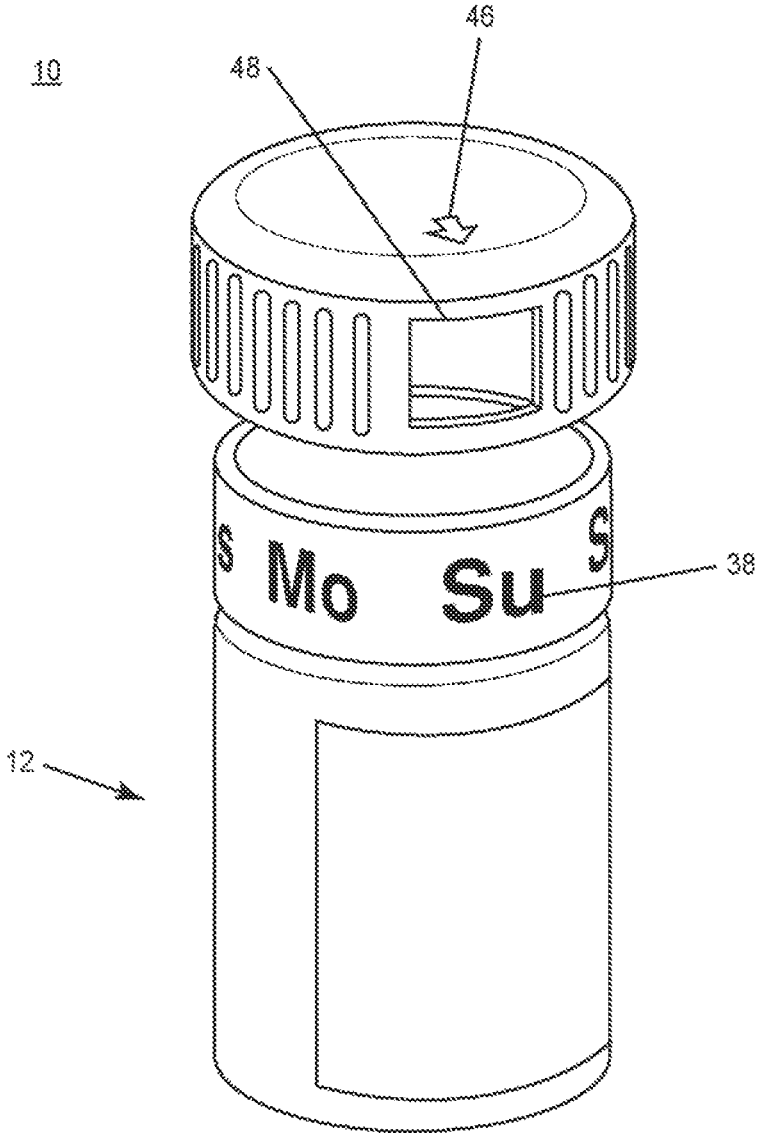
FIG. 2 is a perspective view of the components shown in FIG. 1.
Figure 3:
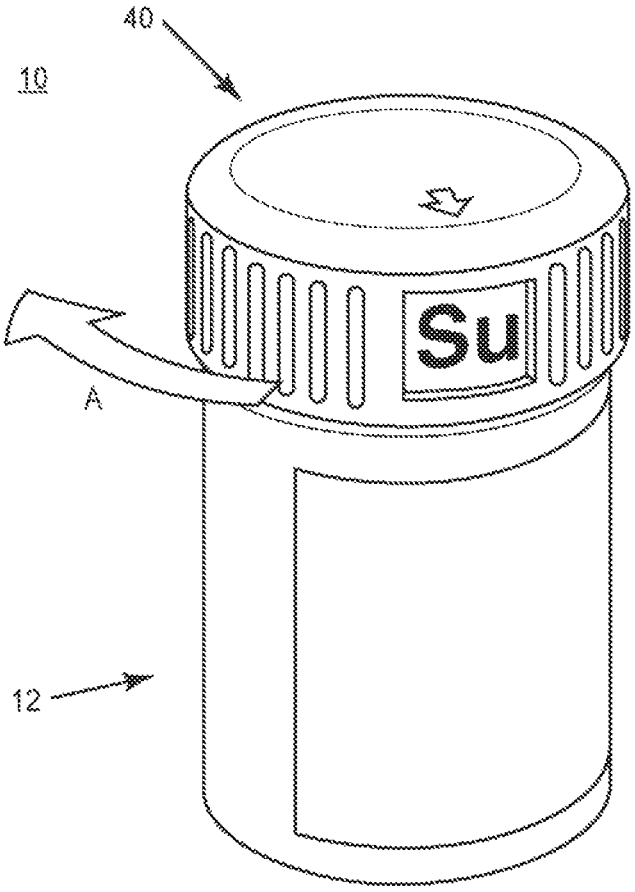
FIG. 3 is a perspective view of the components shown in FIG. 1.
Figure 4:
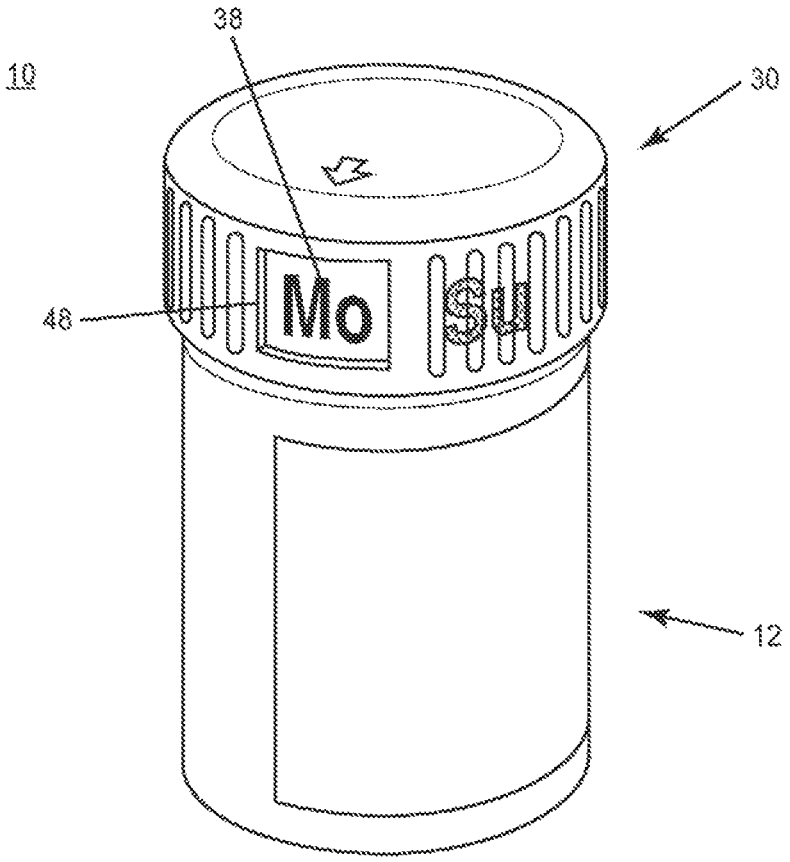
FIG. 4 is a perspective view of the components shown in FIG. 1.
Figure 5:
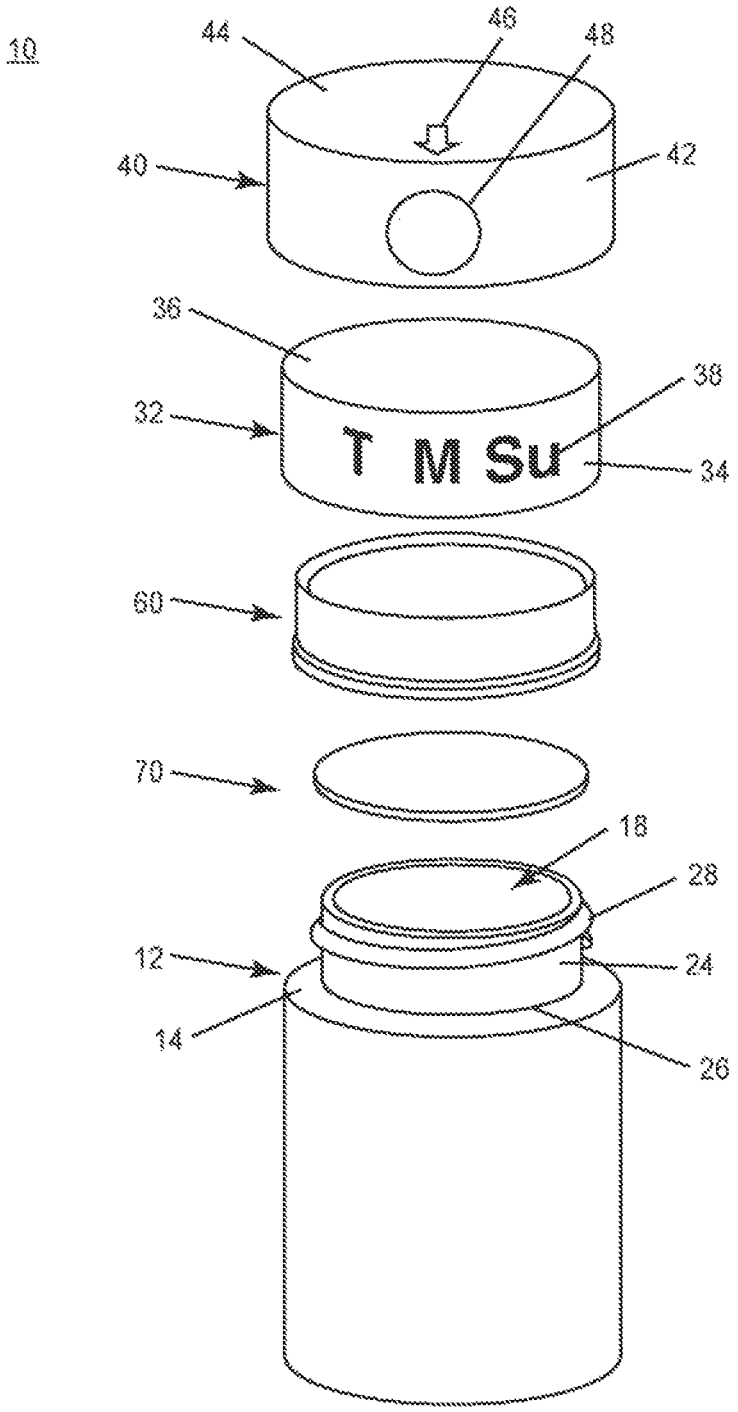
FIG. 5 is an exploded view of the components shown in FIG. 1.

In some embodiments, cap 40 allows a user to view indicia 38 to aid a user in complying with a dosage regimen. Cap 40 includes a window 48 in sidewall 42 which is sized to align with indicia 38. Window 48 may be variously configured, and have a variety of shapes. For example, in various embodiments, window 48 is square shaped, circular, oval, trapezoidal, rhomboid, polygonal, kidney shaped, regular, or irregular. Window 48 is sized to allow visibility of indicia 38. As shown in FIG. 1, window 48 is sized to provide visibility for at least one letter representing a day of the week. In some embodiments, cap 40 includes an indicator 46 to aid in directing a user's attention to window 48. Indicator 46 is shown as an arrow printed onto surface 44. In some embodiments, indicator 46 may include, such as, for example, a dash or a line pointing in the direction of window 48. In some embodiments, cap 40 is transparent or semi-transparent to allow a user to view indicia 38 in the context of surrounding indicia. In some embodiments, as shown in FIG. 2, window 48 is turned to align with "Su" of indicia 38, representing a reminder for a medication to be taken on Sunday. The indicia surrounding "Su" are "Mo" and "Sa" representing a reminder for a medication to be taken on Monday and Saturday. The surrounding indicia are viewable through sidewall 42 on either side of window 48. In some embodiments, the entirety of cap 40 is transparent or semi-transparent such that all indicia 38 disposed around sidewall 34 is visible through sidewall 42. In some embodiments, gripping ridges 50 are disposed around the circumference of sidewall 42. Ridges 50 project from the surface of sidewall 42 to aid a user in rotating lid 30 or cap 40. In some embodiments, ridges 50 are also transparent or semi-transparent to allow a user to see indicia 38 of sidewall 34. In some embodiment, ridges 50 distort the visibility of indicia 38 to obscure portions of indicia 38 that are not aligned with window 48. In other embodiments, cap 40 is opaque or translucent to prevent visibility of indicia 38 that are not aligned with window 48.

Figure 6:
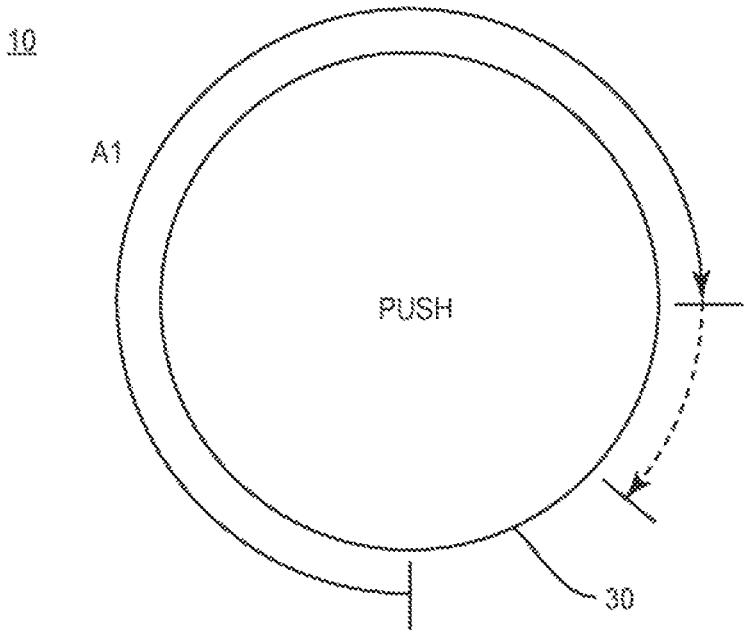
FIG. 6 is a plan view of the components shown in FIG. 1.

In some embodiments, lid 30 includes an advancement mechanism to move cap 40 relative to cap 32. As shown in FIG. 6, lid 30 is rotatable on neck portion 24 to seal cavity 18. Lid 30 is brought into contact with threads 28 and rotates until it reaches a sealing position. In some embodiments, reaching the sealing position is signaled to a user by an audible click. In some embodiments, while in the sealed position, cap 40 is configured to be advanced from indicia 38 to adjacent incremental indicia 38. In some embodiments, in dosage regimens requiring one medication from bottle 12 per day, upon being brought to the sealed position after taking a medication for a given day, a user seals lid 30 on bottle 12, then advances the advancement mechanism to rotate window 48 to the next sequential day represented by indicia 38. In various embodiments, window 48 is rotatable, in a direction shown by arrow A1, with respect to cap 32 once lid 30 has been removed and re-applied to bottle 12. In some embodiments, rotating window 48 a sequential increment of indicia 38 is signaled to a user by an audible click. For example, one or more components of lid 30 can be rotated to an audible or tactile click to indicate a sealing position and/or a stop position. In some embodiments, the click positions may be in sequence. For example, upon reaching a seal position, in the event that display change is required for a dosing regimen or indicia, as described herein, continued rotation of the components of lid 30 can be permitted to a limit of the stop position. In some embodiments, the advancement mechanism prevents rotating window 48 relative to cap 32 more than one increment of indicia 38. In some embodiments, lid 30 includes a stopping mechanism to prevent window 48 from being rotated more than a single increment of indicia 38 after lid 30 is brought to the sealed position. In some embodiments, the advancement mechanism allows window 48 to be rotated a plurality of increments of indicia 38. In some embodiments, window 48 is rotatable in a first direction and not rotatable in a second direction. In some embodiments, window 48 is rotated by a user to an increment of indicia 38 that is sequential after a first increment of indicia 38, and not rotatable by a user to an increment of indicia 38 that comes sequentially before the first increment. In some embodiments, one or more components of lid 30 can be rotated in connection with the advancement mechanism and/or click positions, for each rotation and/or in a range of 45 through 360 degrees.

In some embodiments, the advancement mechanism requires a user to apply a downward force onto lid 30 and then rotate lid 30 relative to bottle 12. In some embodiments, the advancement mechanism includes manual advancement grips on the underside of lid 30 to rotate cap 40 with respect to cap 32. In some embodiments, the advancement mechanism comprises a ratchet wheel attached to one of cap 32 or cap 40 and a plurality of notches extending radially inward from a surface of the other of cap 32 or cap 40. In some embodiments, the advancement mechanism includes a biasing member to allow rotation in a first direction and to prevent rotation in a second direction. In some embodiments, the advancement mechanism is in communication with threads 28 such that window 48 cannot be rotated relative to cap 32 while lid 30 is unscrewed and removed from bottle 12. In some embodiments, one of cap 32 or cap 40 comprises a pawl formed therein or attached thereto that engages a set of teeth formed in the other of cap 32 or cap 40 only when the device is closed. In some embodiments, the advancement mechanism comprises a spring to urge rotation of cap 40 with respect to cap 32 when lid 30 is brought to the sealing position.

In some embodiments, lid 30 includes a threaded insert 60 and/or a sealing gasket 70, which are received by an inner surface of cap 32. In some embodiments, insert 60 includes an outer surface sized to facilitate a friction fit with the inner surface of cap 32. In some embodiments, insert 60 includes threads on the outer surface to engage with threads of cap 32. Insert 60 includes inner threads configured to engage threads 28 of neck portion 24. In some embodiments, the inner threads may include a single thread turn or a plurality of discrete threads to conform to threads 28. Gasket 70 is sized to be received by the inner surface of insert 60. In some embodiments, gasket 70 is made from a compressible material such that when brought into contact with neck portion 24, a contacting surface of gasket 70 partially conforms to the shape of neck portion 24.

In various embodiments, lid 30 includes child-resistant features to prevent a child from removing lid 30 from bottle 12. In one embodiment, removal of lid 30 requires a patient to push down and rotate relative to bottle 12. In one embodiment, removal of lid 30 requires a patient to squeeze opposite sides and rotate relative to bottle 12. In one embodiment, removal of lid 30 requires a patient to first rotate lid 30 relative to bottle 12 to align notches on lid 30 and bottle 12 (not shown) and then pull lid 30 from bottle 12.

In some embodiments, lid 30 is provided with instructions to aid a patient in removal from bottle 12. The instructions may be presented in the form of a graphic, such as, for example, an arrow with a lock, or text, such as, for example, "press down and turn". In some embodiments, the instructions may be printed onto lid 30.

In some embodiments, bottle 12 comprises a disposable dispensing device that provides therapeutic and/or nutritional support to an animal by increasing compliance with a dosing regimen. In some embodiments, a dose of medicament, medication or drug can include, such as, for example, a chewable tablet, quick dissolve tablet, effervescent tablet, reconstitutable powder, elixir, liquid, solution, suspension, emulsion, tablet, multi-layer tablet, bi-layer tablet, capsule, soft gelatin capsule, hard gelatin capsule, caplet, lozenge, chewable lozenge, bead, powder, granules, dispersible granules, cachets, douche, suppository, cream, topical, inhalant, aerosol inhalant, patch, particle inhalant, implant, depot implant, dragee, ampoule, ingestible, injectable, infusion, health bar, liquid, food, nutritive food, functional food, yogurt, gelatin, cereal, cereal coating, animal feed and/or combinations thereof.

In some embodiments, indicia of a medication regimen, direction, instruction and/or prescription for administration of a medication regimen may include dosage day indicia, a specific day of the week, such as Monday, Tuesday, Wednesday, Thursday, Friday, Saturday, Sunday or an abbreviation of said day, a specific date or a general succession of days, such as day 1, day 2, day 3. In some embodiments, indicia may include time indicia that may be, such as, for example, a general time of the day or a specific time of the day, such as, for example, AM, PM, morning, afternoon, evening, day, night, daytime, nighttime and combinations thereof. In some embodiments, indicia may include each separate row or column on bottle 12 indicating a time of day, such as AM doses and PM doses. In some embodiments, bottle 12 may be color coded for time indicia. In some embodiments, one or more components of medicament dispensing system 10 may include a key defining or explaining color coding.

In some embodiments, a dose of medicament, medication or drug may comprise vitamin A, B vitamins, vitamin C, vitamin D, vitamin E, vitamin K, essential fatty acids, folic acid, iron, calcium, magnesium, potassium, copper, chromium, zinc, molybdenum, iodine, boron, selenium, manganese, derivatives thereof and/or combinations thereof. In some embodiments, biologically-active substances may include thiamin, thiamin pyrophosphate, riboflavin, flavin mononucleotide, flavin adenine dinucleotide, niacin, nicotinic acid, nicotinamide, niacinamide, nicotinamide adenine dinucleotide, tryptophan, biotin, pantothenic acid, ascorbic acid, retinol, retinal, retinoic acid, beta-carotene, 1,25-dihydroxycholecalciferol, 7-dehyrdocholesterol, alpha-tocopherol, tocopherol, tocotrienol, menadione, menaquinone, phylloquinone, naphthoquinone, calcium, calcium carbonate, calcium sulfate, calcium oxide, calcium hydroxide, calcium apatite, calcium citrate-malate, calcium gluconate, calcium lactate, calcium phosphate, calcium levulinate, phosphorus, potassium, sulfur, sodium, docusate sodium, chloride, magnesium, magnesium stearate, magnesium carbonate, magnesium oxide, magnesium hydroxide, magnesium sulfate, copper, iodine, zinc, chromium, molybdenum, carbonyl iron, ferrous fumarate, polysaccharide iron, and/or combinations and derivatives thereof.

In some embodiments, a dose of medicament, medication or drug may be prescription and/or non-prescription substances. In some embodiments, the prescription substance may be a hormone replacement agent, a contraceptive agent, an osteoporotic agent, a chemotherapeutic agent, an anti-infective agent, analgesic, a steroid, an appetite suppressant, a weight loss agent, a tobacco antagonist, a cholesterol reducer and/or combinations thereof.

In some embodiments, the prescription substances may include, such as, for example, erythromycin, penicillins, cephalosporins, theophylline, albuterol, terbutaline, diltiazem, propranolol, nifedepine, clonidine, thioridazine, diazepam, meclizine, ergoloid mesylates, chlorpromazine, carbidopa, levodopa, beclomethasone diproprionate, budesonide, dexamehasone, flunisolide, fluticasone proprionate, mometasone furoate, triamcinolone acetonide, beconase, pulmicort, rhinocort, decadron, aerobid/nasolide, flovent/flonase, azmacort, amprenavir, adefovir dipivoxil, zidovudine, azidothymidine, AZT, paclitaxel, cyclophosphamide, teniposide, taxol, cytoxan, vumon, methotrexate, methotrexate, cisplatin, carboplatin, oxaliplatin, platinol, paraplatin, adriamycin, bleomycin, dactinomycin, daunorubicin, doxorubicin, indarubicin, mitomycin, blenoxane, cosmegen, cerubidine, rubex, indamycin, mutamycin, BCNU, streptozocin, vinblastine, thiotepa, conjugated estrogens, esterified estrogens, estropipate, estradiol, ethinyl estradiol, medroxyprogesterone, meprobamate, desogestrel, levonorgestrel, norethindrone, norethindrone acetate, norgestimate, norgestrel, raloxifene, tamoxifen, methyltestosterone, quinapril, losartan, sotalol, alendronate, atorvastatin, colestipol, clofibrate, and/or combinations thereof.

In some embodiments, the non-prescription substance can be a vitamin or derivative thereof, and/or a mineral compound or derivative thereof. In some embodiments, the vitamin or mineral compound may be, such as, for example, thiamin, thiamin pyrophosphate, riboflavin, flavin mononucleoride, flavin adenine dinucleotide, niacin, nicotinic acid, nicotinamide, niacinamide, nicotinamide adenine dinucleotide, tryptophan, biotin, folic acid, pantothenic acid, ascorbic acid, retinol, retinal, retinoic acid, beta-carotene, 1,25-dihydroxycholecalciferol, 7-dehydrocholesterol, alpha-tocopherol, tocopherol, tocotrienol, menadione, menaquinone, phylloquinone, naphthoquinone, calcium, calcium carbonate, calcium sulfate, calcium oxide, calcium hydroxide, calcium apatite, calcium citrate-malate, calcium gluconate, calcium lactate, calcium phosphate, calcium levulinate, phosphorus, potassium, sulfur, sodium, docusate sodium, chloride, magnesium, magnesium stearate, magnesium carbonate, magnesium oxide, magnesium hydroxide, magnesium sulfate, copper, iodine, zinc, chromium, molybdenum, carbonyl iron, ferrous fumarate, polysaccharide iron, and combinations and derivatives thereof. In some embodiments, the derivatives of vitamin compounds include salts, alkaline salts, esters and chelates of any vitamin compound. In some embodiments, the nonprescription substance can be a herbal compound, herbal extract, derivative thereof and/or combinations thereof.

In use, bottle 12 having lid 30 is portable such that the user/patient transports and/or carries bottle 12 upon discharge. At the time specified by indicia 38 positioned in window 48, a user translates lid 30 from the sealed position and removes lid 30 from bottle 12. The user takes a dosage of medication as required by a dosage regimen. The user contacts lid 30 with neck portion 24 and rotates lid 30 with threads 28 until lid 30 clicks into the sealed position. Once in the sealed position, the user utilizes the advancement mechanism to move cap 40 with respect to cap 32. The user rotates window 48 from the increment of indicia 38 representing the dosage just taken to a sequential increment of indicia 38 representing a reminder for the next dosage to be taken, to facilitate compliance with a dosage regimen.

Figure 7:
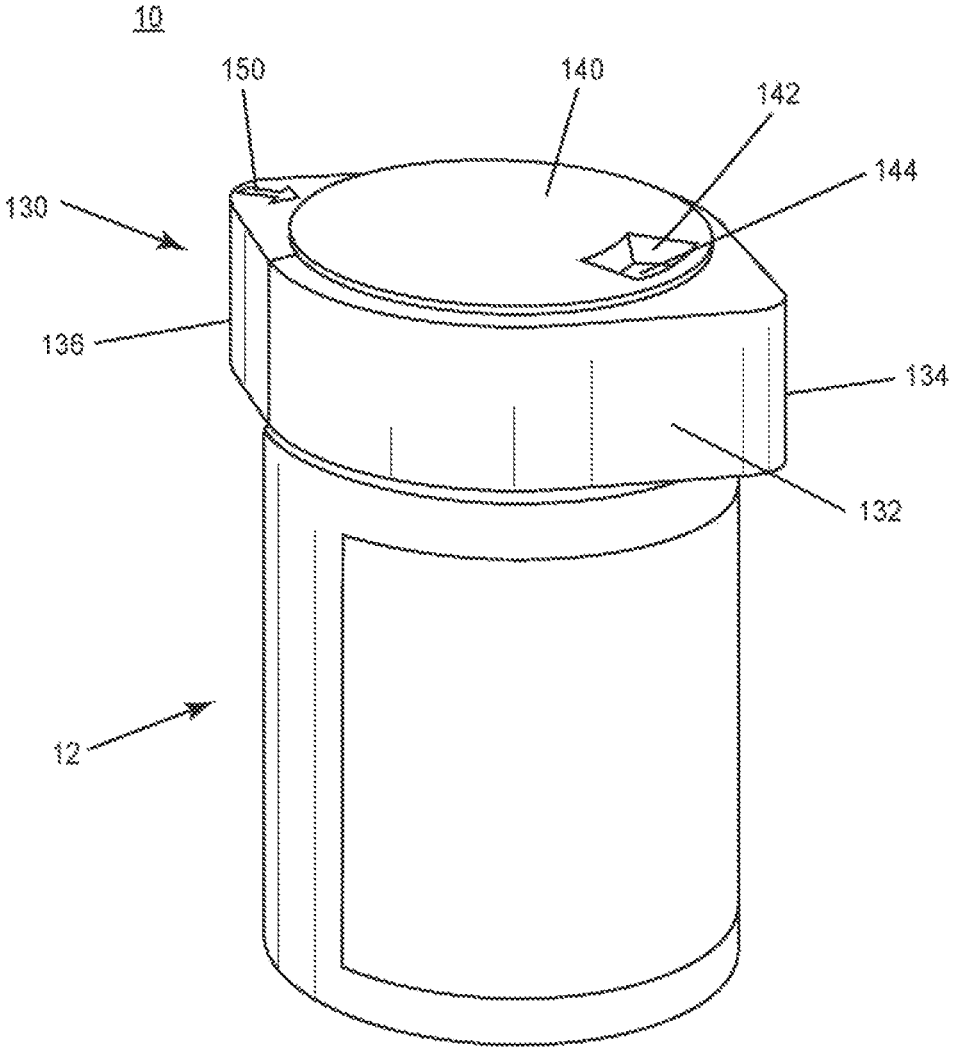
FIG. 7 is a perspective view of components of one embodiment of a system in accordance with the principles of the present disclosure.
Figure 8:
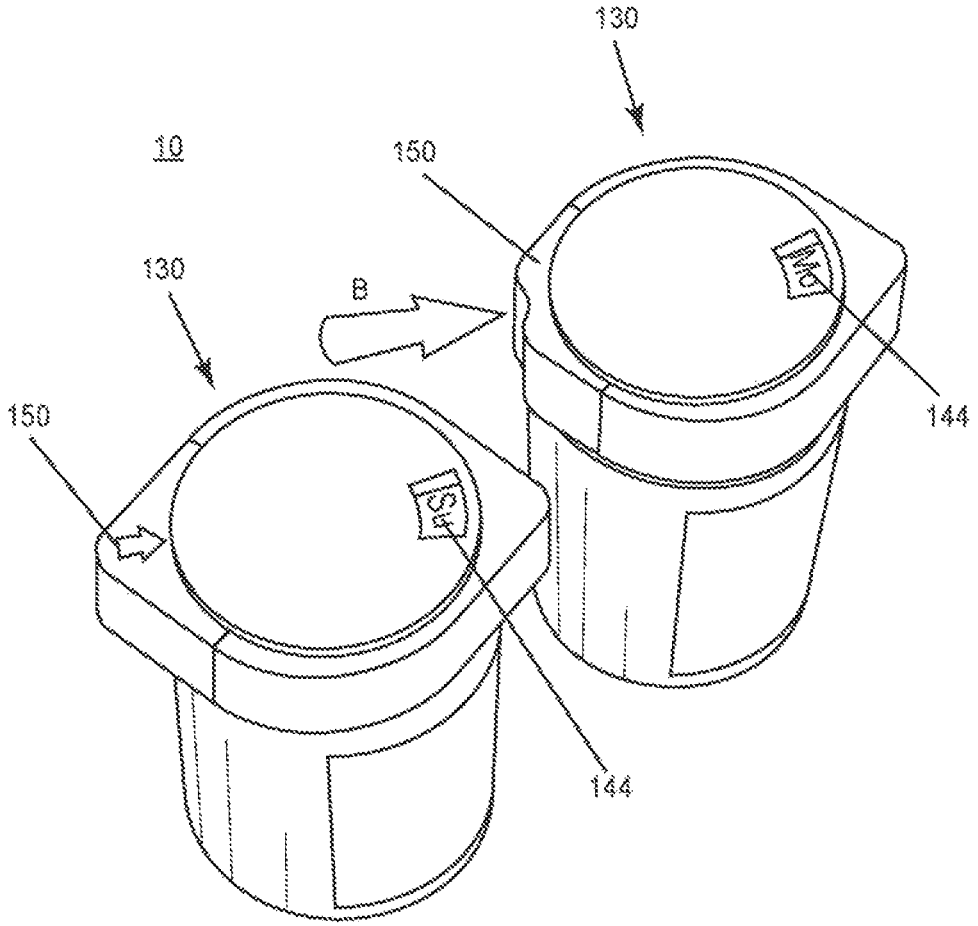
FIG. 8 is a perspective view of the components shown in FIG. 7.
Figure 9:
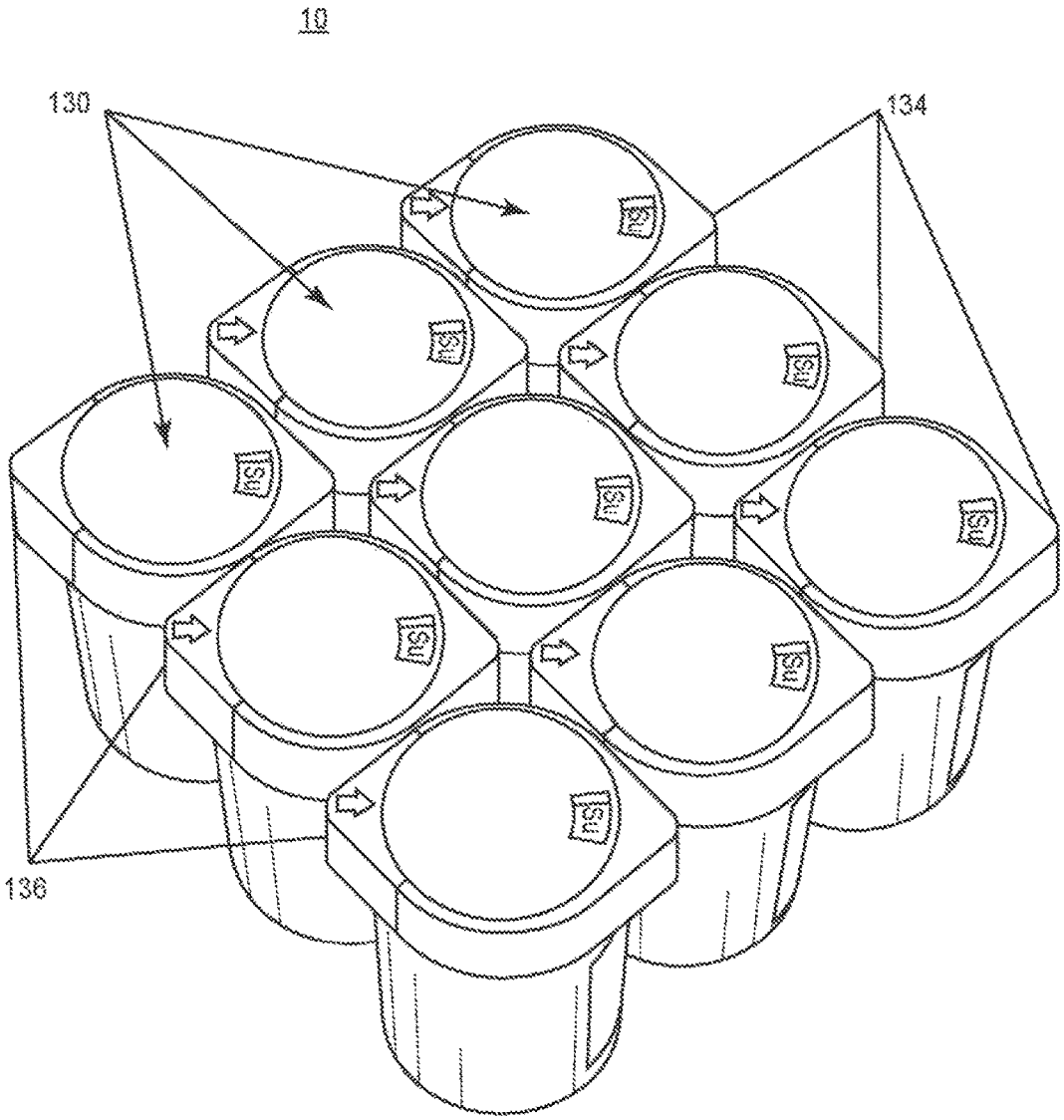
FIG. 9 is a perspective view of components of one embodiment of a system in accordance with the principles of the present disclosure.

In some embodiments, as shown in FIGS. 7-9, medicament dispensing system 10, similar to the systems and methods described herein, includes a lid 130. As shown in FIG. 7, lid 130 comprises a body 132 having an oblong shape with two oppositely positioned gripping portions. A gripping portion 134 is positioned opposite a gripping portion 136 comprising a button 150, as discussed herein. Gripping portions 134, 136 extend from body 132 to facilitate gripping by a user. In some embodiments, an inner surface of lid 130 includes threading configured to engaged threads 28 on neck portion 24. In some embodiments, an inner surface of lid 130 is configured to receive a threaded insert 60 or a gasket 70, similar to lid 30.

Body 132 includes a top surface that is substantially covered by cover 140. Cover 140 has a shape and size to conform to the diameter of lid 130, and includes a window 142, similar to the windows described herein, to aid a user in maintaining compliance with a dosage regimen. Window 142 is positioned to allow a user to view indicia 144, as described herein. Window 142 may be variously configured, and have a variety of shapes. For example, in various embodiments, window 142 is square shaped, circular, oval, trapezoidal, rhomboid, polygonal, kidney shaped, regular, or irregular. Window 142 is sized to allow visibility of indicia 144. For example, as shown in FIG. 8, window 142 is sized to allow visibility for one to two letters representing a day of the week. In various embodiments, indicia 144 are presented to represent days of the week. In some embodiments, indicia 144 are presented to represent times of the day in which a medication is to be taken by a user. In some embodiments, indicia 144 are presented as a combination of time and day in which a medication is to be taken by a user. In some embodiments, indicia 144 are radially arrayed and spaced evenly about a circular indicia panel positioned between body 132 and cover 140. In some embodiments, indicia 144 are arranged on the panel such that incremental rotation of the panel moves sequential indicia 144 to align with window 142. In some embodiments, cover 140 is opaque such that only indicia 144 aligned with window 142 is visible to a user. In other embodiments, cover 140 is transparent or semi-transparent to provide a user visibility of indicia 144 aligned with window 142 in context with surrounding indicia.

In some embodiments, gripping portion 136 includes button 150 configured to advance the alignment of indicia 144 relative to window 142 when pressed, in the direction shown by arrow B. In some embodiments, button 150 comprises a compressible and/or biased internal member and a deformable and/or elastic casing such that a user can easily deform and compress the internal member by applying a force to button 150, as shown in FIG. 8. The deformable casing may comprise a shaped polymeric sheet of which has memory shape qualities such that the casing returns to the original shape of gripping portion 136 after a user releases pressure on button 150. In some embodiments, the casing includes a rubberized surface to aid a user in gripping button 150. In some embodiments, the internal member comprises a movable piston being biased to an uncompressed position. In some embodiments, a spring biases the internal member outward and requires a predetermined amount of force applied by a user to be compressed.

Upon pressing button 150, a panel comprising indicia 144 is rotated a distance such that a first increment of indicia 144 is moved from the view of window 142, and a second increment of indicia 144 is moved into the view of window 142. In some embodiments, pressing button 150 rotates indicia 144 a single increment. In some embodiments, pressing button 150 rotates indicia 144 a plurality of increments. In some embodiments, pressing button 150 rotates indicia 144 in only one direction.

As shown in FIG. 9, gripping portions 134, 136 are oppositely positioned and tapered to facilitate close packing of bottles 12. In some embodiments, gripping portions 134, 136 are configured such that when arranged next to one another, bottles 12 are spaced apart equally. Gripping portions 134, 136 add to the functionality of button 150 while requiring minimal materials for packaging. Such a configuration allows a user requiring multiple bottles 12 to maintain an organized arrangement of bottles 12 while taking a minimal amount of space.

In use, bottle 12 having lid 130 is portable such that the user/patient transports and/or carries bottle 12 upon discharge. At the time specified by indicia 144 positioned in window 142, a user moves lid 130 from the sealed position and removes lid 130 from bottle 12. The user takes a dosage of medication as required by a dosage regimen. The user contacts lid 130 with neck portion 24 and rotates lid 130 with threads 28 until lid 130 clicks into the sealed position. Once in the sealed position, the user presses button 150 to move indicia 144 with respect to window 142 from the increment of indicia 144 representing the dosage taken to a sequential increment of indicia 144 representing a reminder for the next dosage to be taken, in order to facilitate compliance with a dosage regimen.

Figure 10:
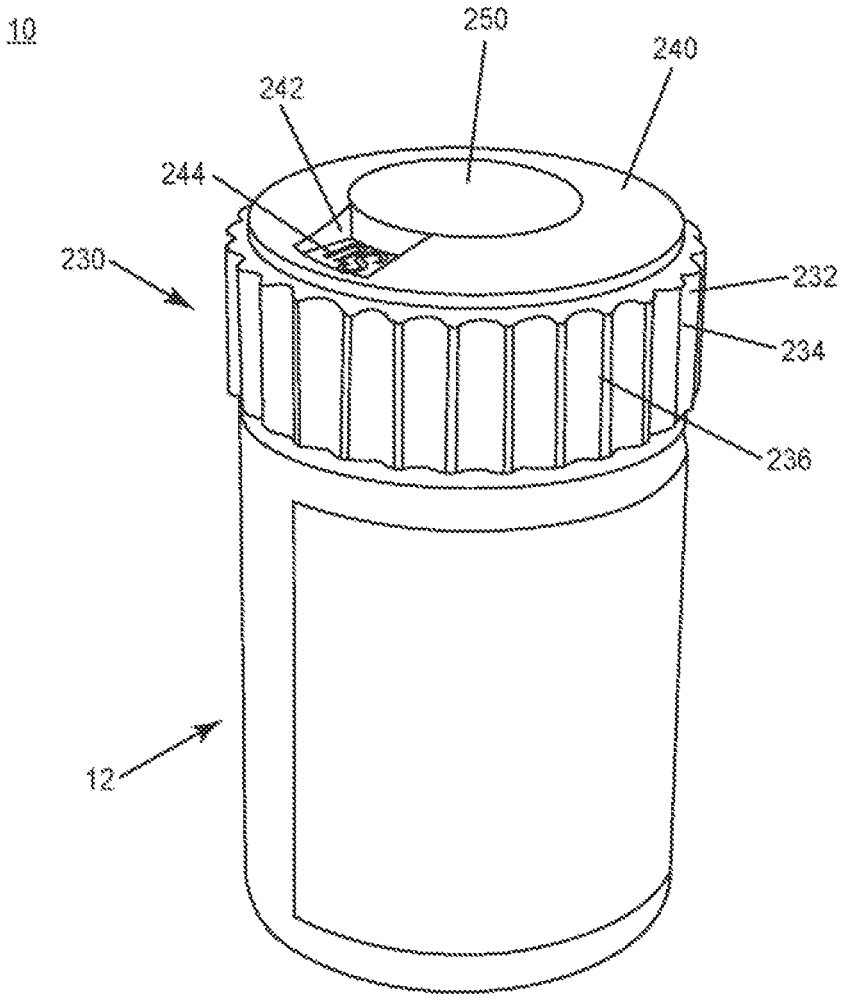
FIG. 10 is a perspective view of components of one embodiment of a system in accordance with the principles of the present disclosure.
Figure 11:
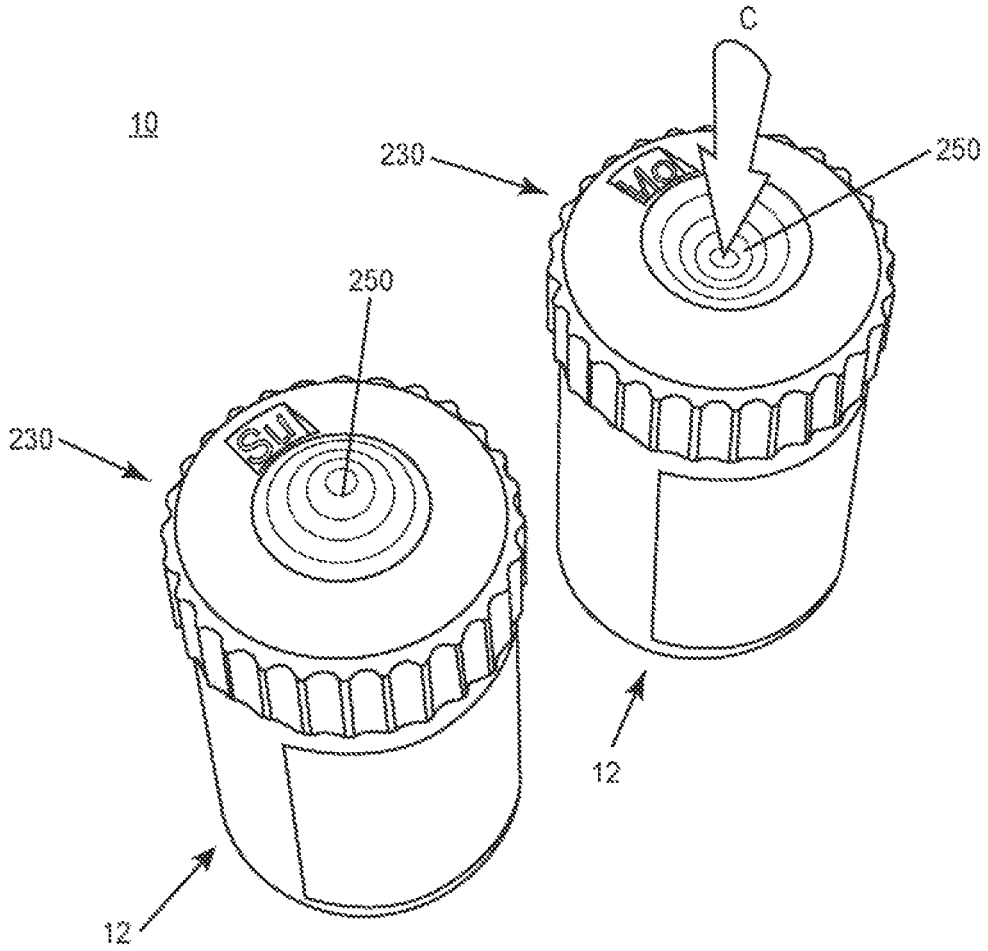
FIG. 11 is a perspective view of the components shown in FIG. 10.

In some embodiments, as shown in FIGS. 10-11, medicament dispensing system 10, similar to the systems and methods described herein, includes a lid 230. As shown in FIG. 10, lid 230 comprises a body 232 having a substantially circular shape. A sidewall 234 includes a plurality of gripping ridges 236 radially arrayed about the circumference of sidewall 234. Ridges 236 project from the surface of sidewall 234 to aid a user in rotating lid 230. In some embodiments, an inner surface of lid 230 includes threading configured to engage threads 28 on neck portion 24. In some embodiments, an inner surface of lid 230 is configured to receive a threaded insert 60 or a gasket 70, similar to lid 30.

Body 232 includes a top surface that is substantially covered by a cover 240. Cover 240 has a shape and size to conform to the diameter of lid 230, and includes a window 242, similar to the windows described herein, to aid a user in maintaining compliance with a complex dosage regimen. Window 242 is positioned to allow a user to view indicia 244, as described herein. Window 242 may be variously configured, and have a variety of shapes. For example, in various embodiments, window 242 is square, circular, oval, trapezoidal, rhomboid, polygonal, kidney shaped, regular, or irregular. Window 242 is sized to allow visibility of indicia 244. For example, as shown in FIG. 11, window 242 is sized to allow visibility for one to two letters representing a day of the week. In various embodiments, indicia 244 are presented to represent days of the week. In some embodiments, indicia 244 are presented to represent times of the day in which a medication is to be taken by a user. In some embodiments, indicia 244 are presented as a combination of time and day in which a medication is to be taken by a user. In some embodiments, indicia 244 are radially arrayed and spaced evenly about a circular indicia panel positioned between body 232 and cover 240. In some embodiments, indicia 244 are arranged on the panel such that incremental rotation of the panel moves sequential indicia 244 to align with window 242. In some embodiments, cover 240 is opaque such that only indicia 244 aligned with window 242 is visible to a user. However, in other embodiments, cover 240 is transparent or semi-transparent to provide a user visibility of indicia 244 aligned with window 242 in context with surrounding indicia.

In some embodiments, cover 240 includes a central button 250 configured to advance the alignment of indicia 244 relative to window 242 when pressed, in the direction shown by arrow C. In some embodiments, button 250 comprises a compressible and/or biased internal member and a deformable and/or elastic casing such that a user can easily deform and compress the internal member by applying a force to button 250, as shown in FIG. 11. Button 250 includes a generally convex shape when in the rest position, and a concave shape when compressed. The casing may comprise a shaped polymeric sheet of which has memory shape qualities such that the casing returns to a convex shape after a user releases pressure on button 250. In some embodiments, the casing includes a rubberized surface to aid a user in gripping button 250. In some embodiments, the internal member comprises a movable piston being biased to an uncompressed position. In some embodiments, a spring biases the internal member outward and requires a predetermined amount of force applied by a user to be compressed. In some embodiments, button 250 has a planar shape in the rest position.

Upon pressing button 250, a panel comprising indicia 244 is rotated a distance such that a first increment of indicia 244 is moved from the view of window 242, and a second increment of indicia 244 is moved into the view of window 242. In some embodiments, pressing button 250 rotates indicia 244 a single increment. In some embodiments, pressing button 250 rotates indicia 244 a plurality of increments. In some embodiments, pressing button 250 rotates indicia 244 in only one direction.

In use, bottle 12 having lid 230 is portable such that the user/patient transports and/or carries bottle 12 upon discharge. At the time specified by indicia 244 positioned in window 242, a user moves lid 230 from the sealed position and removes lid 230 from bottle 12. The user takes a dosage of medication as required by a dosage regimen. The user contacts lid 230 with neck portion 24 and rotates lid 230 with threads 28 until lid 230 clicks into the sealed position. Once in the sealed position, the user presses button 250 to move indicia 244 with respect to window 242 from the increment of indicia 244 representing the dosage taken to a sequential increment of indicia 244 representing a reminder for the next dosage to be taken, in order to facilitate compliance with a dosage regimen.

In some embodiments, as shown in FIGS. 12-15, medicament dispensing system 10, similar to the systems and methods described herein, includes a bottle 12, as described herein, and a lid 330, similar to lid 30 described herein.

Lid 330 includes an indicator cap 332. Indicator cap 332 includes a cap 334 and a ring 336. Ring 336 is configured for rotation relative to cap 334. In some embodiments, cap 334 includes an inner surface sized to receive threaded insert 60 and/or a sealing gasket 70, as discussed herein. Cap 334 includes a surface 337. Surface 337 includes one or more ribs, such as, for example, ribs 350*a*, 350*b*. Ribs 350*a*, 350*b* are configured for engagement with a portion of a cap 340, similar to cap 40, as described herein. Ribs 350*a*, 350*b* are configured as stops for rotation of cap 334 to advance indicia 338, similar to indicia 38, described herein. In some embodiments, ribs 350*a*, 350*b* comprise a unit of advance and/or increment of indicia for one or more components of a dosage regimen.

Ring 336 includes an outer surface 352 that includes indicia 338. Indicia 338 is disposed circumferentially about surface 352. Ring 352 includes an opening 354. Opening 354 is configured for disposal of cap 332 such that ribs 350*a*, 350*b* are engageable by cap 340. Ring 336 includes a plurality of protrusions, such as, for example, teeth 356. Teeth 356 are configured for engagement with a portion of cap 340, as described herein. Teeth 356 are positioned about ring 336 such that movement of cap 340 between teeth 356 advances cap 340 a single dose and displays indicia 338.

Cap 340 is configured to aid a user in maintaining compliance with a complex dosage regimen. Cap 340 includes a circumferential sidewall 342 extending from the periphery of a top surface 344. In some embodiments, surface 344 is solid and continuous. Cap 340 includes an inner diameter that is configured to fit snugly over cap 334 and ring 336. In some embodiments, cap 340 allows a user to view indicia 338 to aid a user in complying with a dosage regimen. Cap 340 includes a window 348, similar to window 48 as described herein, in sidewall 342 which is sized to align with indicia 338 disposed on ring 336.

In some embodiments, cap 340 includes a surface 360 that defines a rib 362. Rib 362 is configured for engagement with ribs 350 to facilitate advancement of indicia 338. Cap 340 includes a surface 364 that includes a protrusion, such as, for example, a tooth 366. Tooth 366 is configured to engage teeth 356 to facilitate incremental rotation of cap 340 relative to ring 336. In some embodiments, cap 340 may include one or more teeth 366.

Figure 12:
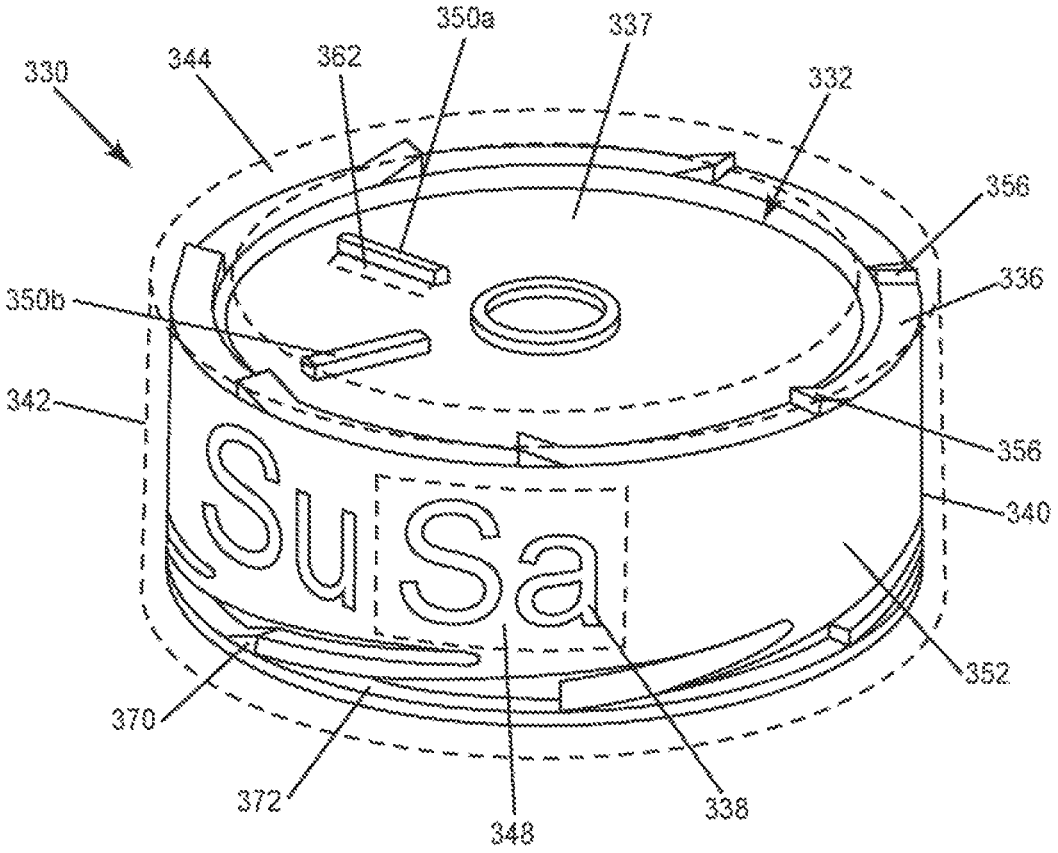
FIG. 12 is a perspective view of components of one embodiment of a system in accordance with the principles of the present disclosure.

In use, in some embodiments, medicament dispensing system 10 having lid 330 is employed with a method, which includes the step of removing lid 330 from bottle 12. Rib 362 is disposed adjacent rib 350*a*, as shown in FIG. 12. Cap 340 is manipulated for rotation in a counter-clockwise direction. Teeth 366 are disposed to engage teeth 356 such that cap 340 and ring 336 rotate in unison, and resist and/or prevent advancement and/or change of indicia 338. As such, display of indicia "Sa" is maintained through window 348. In some embodiments, a flexible cantilever 372 is molded with ring 336 and provides axial motion to the assembly of cap 340 and ring 336 during rotation, cap removal and/or cap attachment. In some embodiments, cantilever 372 resists and/or prevents back-up of components of lid 330, for example, ring 336 relative to cap 334.

Figure 13:
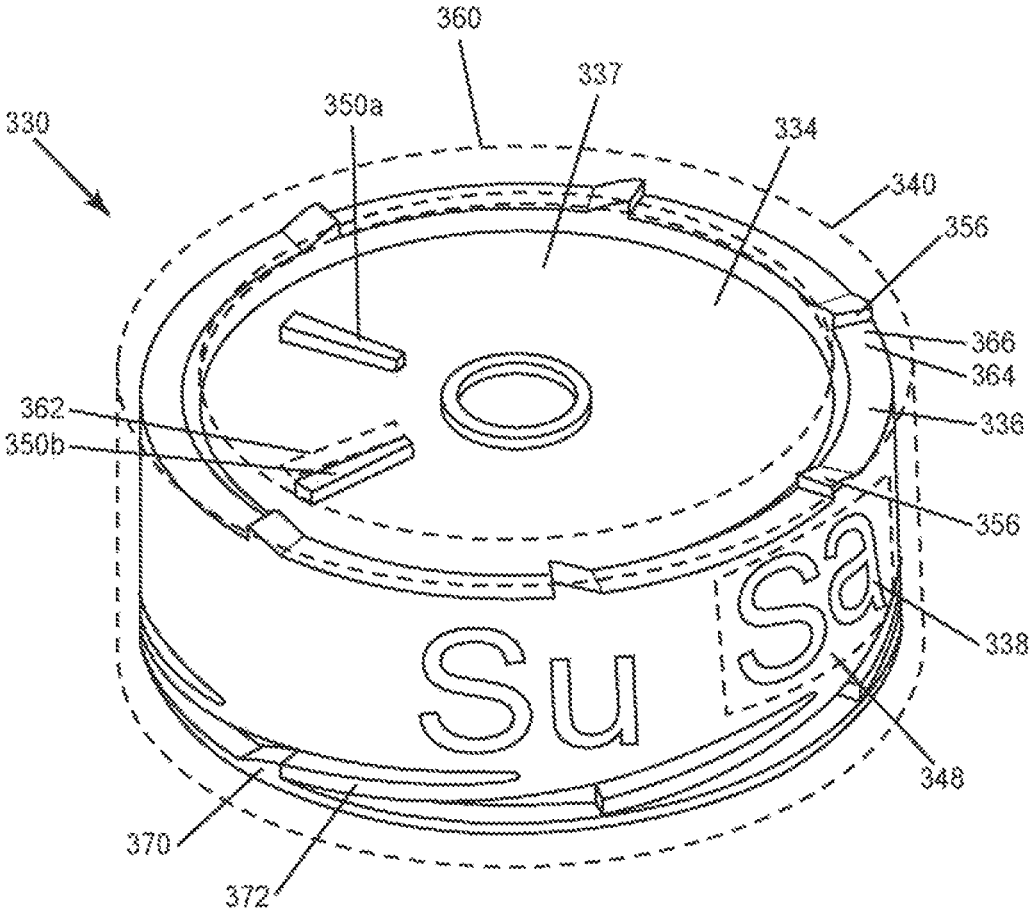
FIG. 13 is a perspective view of components of one embodiment of a system in accordance with the principles of the present disclosure.

Cap 340 and ring 336 rotate in unison such that rib 362 rotates between ribs 350*a*, 350*b* in a counter-clockwise direction to a limit of travel at rib 350*b*, as shown in FIG. 13. Cantilever 372 flexes over teeth 370 of cap 334 in the counter-clockwise direction to advance ring 336 a single advance position. Rib 362 engages rib 350*b* such that the lid 330 assembly rotates in the counter-clockwise direction and lid 330 is removed from bottle 12. In some embodiments, lid 330 is unthreaded from bottle 12.

In some embodiments, medicament dispensing system 10 having lid 330 is employed with a method, which includes the step of attaching and/or re-attaching lid 330 with bottle 12. Rib 362 is disposed adjacent rib 350*b*, as shown in FIG. 13. Cap 340 is manipulated for rotation in a clockwise direction such that the lid 330 assembly rotates in the clockwise direction and lid 330 is attached and/or re-attached with bottle 12.

Figure 14:
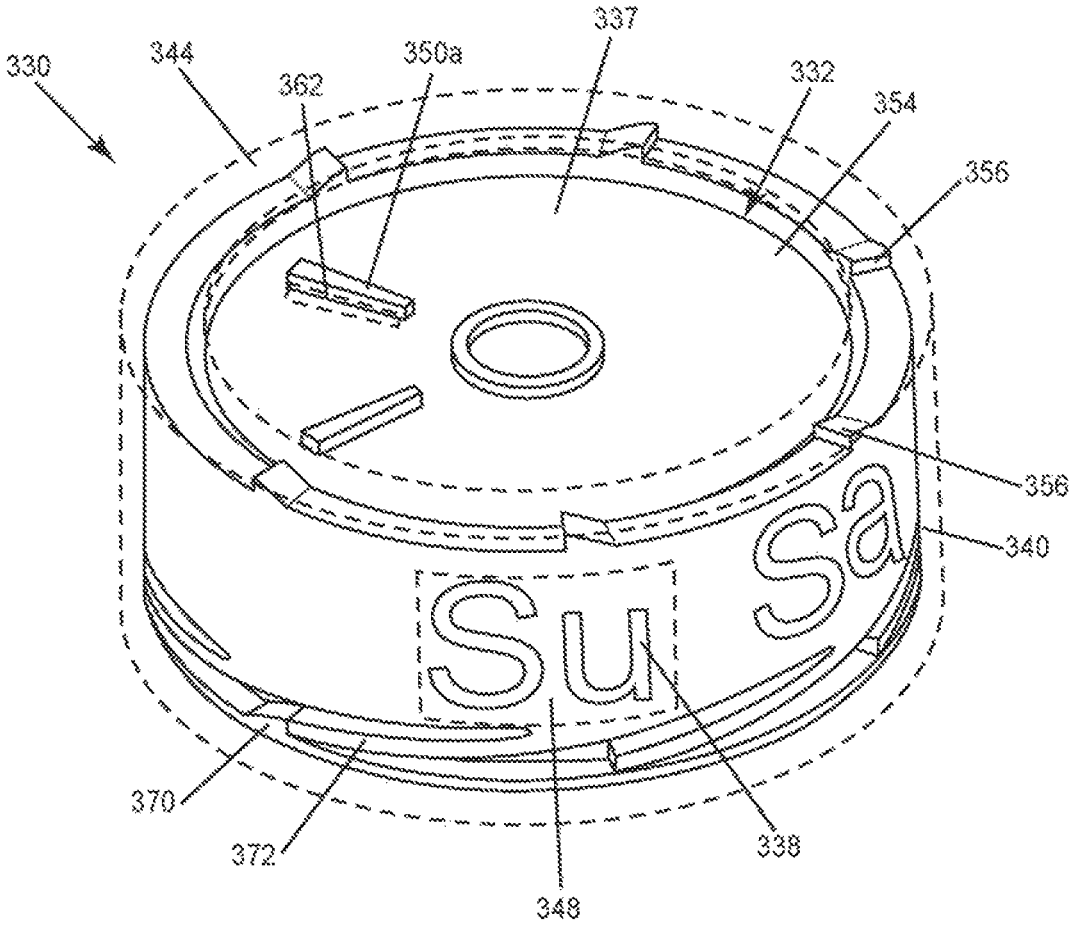
FIG. 14 is a perspective view of components of one embodiment of a system in accordance with the principles of the present disclosure.
Figure 15:
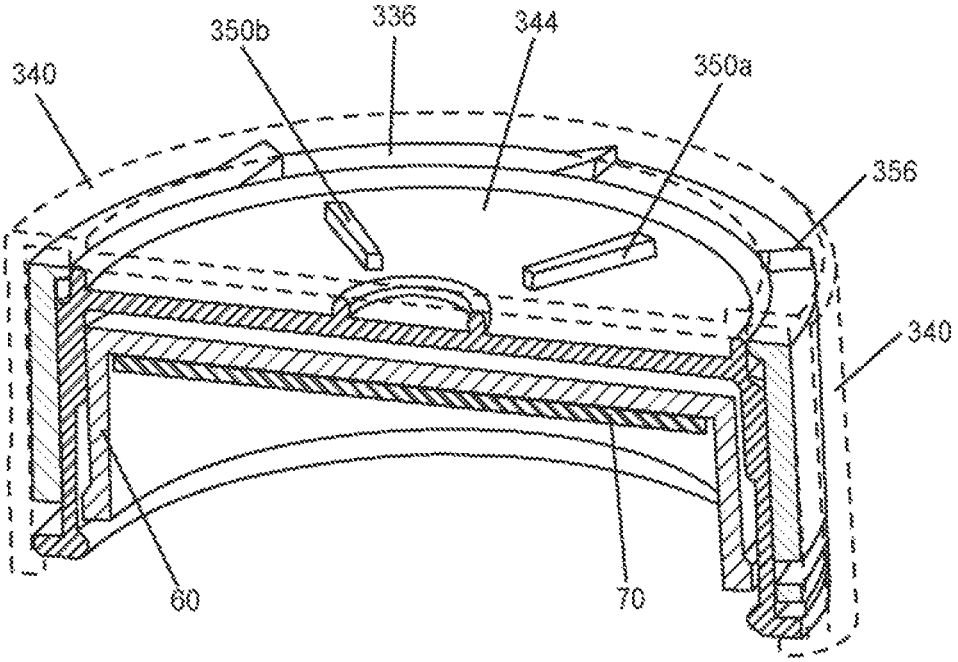
FIG. 15 is a cross section view of the components shown in FIG. 12.

Teeth 366 snap over teeth 356 such that cap 340 rotates in a clockwise direction relative to ring 336 and cap 334. Rib 362 rotates between ribs 350*a*, 350*b* in a clockwise direction to a limit of travel at rib 350*a*, as shown in FIG. 14. Window 348 rotates in the clockwise direction with cap 340 and relative to ring 336 to display indicia "Su" for incremental advancement of the dosage regimen indicia 338.

Figure 16:
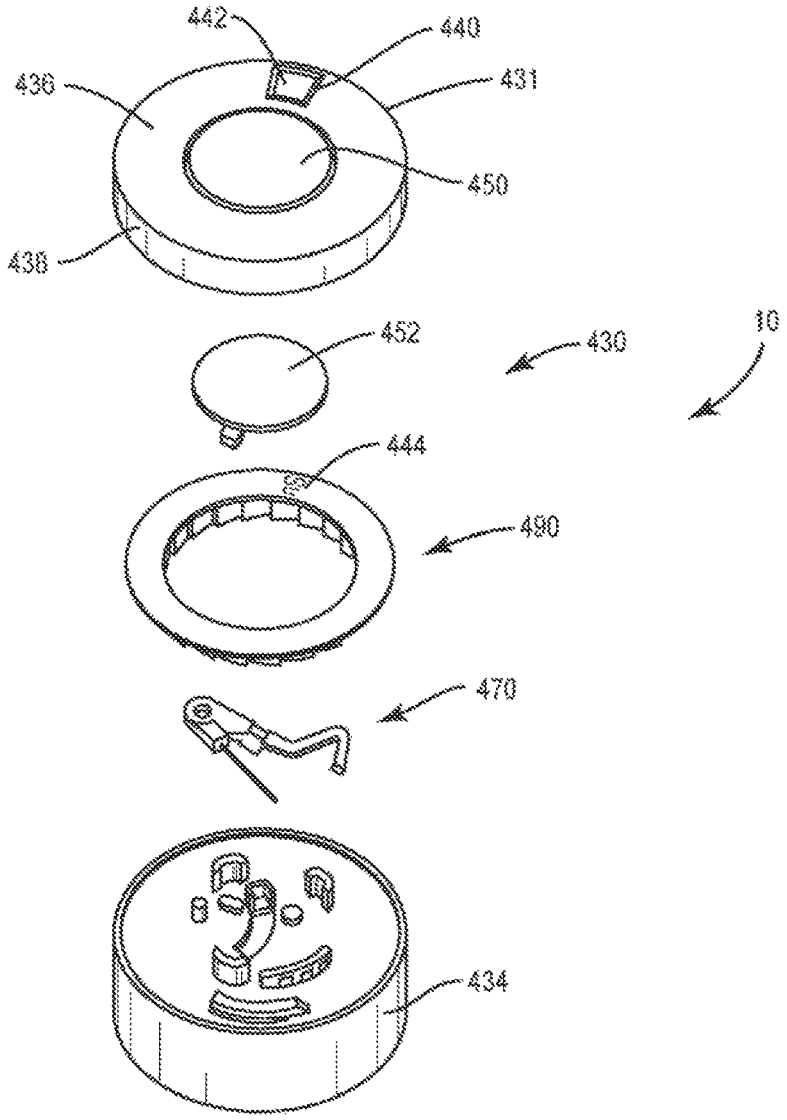
FIG. 16 is an exploded view of components of the system in accordance with the principles of the present disclosure.
Figure 17:
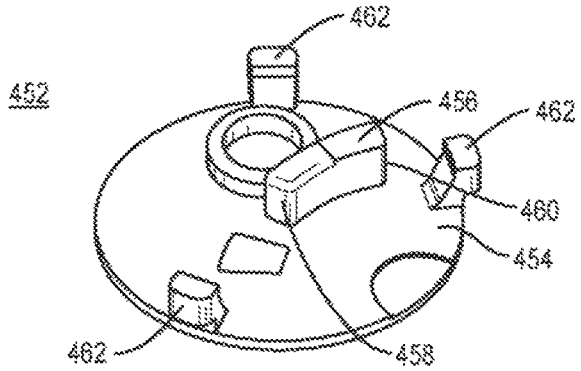
FIG. 17 is a perspective view of components of the system shown in FIG. 16.

In some embodiments, as shown in FIGS. 16-23, medicament dispensing system 10, similar to the systems and methods described herein, includes a lid 430, similar to lid 230 described herein. As shown in FIG. 16, lid 430 comprises a part, such as, for example, an upper cap 432 and a part, such as, for example, a lower cap 434.

Cap 432 includes a top 436 and a sidewall 438. Top 436 includes a surface 440 that defines a window 442, similar to the windows described herein, to aid a user in maintaining compliance with a complex dosage regimen. Window 442 is positioned to allow a user to view indicia 444, as described herein. Window 442 may be variously configured, and have a variety of shapes. For example, in various embodiments, window 442 is square, circular, oval, trapezoidal, rhomboid, polygonal, kidney shaped, regular, or irregular. Window 442 is sized to allow visibility of indicia 444. For example, as shown in FIG. 16, window 442 is sized to allow visibility for one to two letters representing a day of the week. In some embodiments, top 436 is opaque such that only indicia 444 aligned with window 442 is visible to a user. However, in other embodiments, top 436 is transparent or semi-transparent to provide a user visibility of indicia 444 aligned with window 442 in context with surrounding indicia.

In some embodiments, side wall 438 includes a plurality of gripping ridges radially arrayed about the circumference of sidewall 438. In some embodiments, the ridges project from the surface of sidewall 438 to aid a user in rotating lid 430.

In some embodiments, cap 432 includes a central button 450 configured to advance indicia 444 relative to window 442 when pressed. In some embodiments, button 450 comprises a compressible and/or biased internal member and a deformable and/or elastic casing such that a user can easily deform and compress the internal member by applying a force to button 450, as shown in FIG. 16.

In some embodiments, button 450 includes a part, such as, for example, a rigid button 452. Button 452 is configured to engage an advancement mechanism, such as, for example, a pawl 470, as described herein. Button 452 includes a surface 454 that defines a protrusion 456. In some embodiments, protrusion 456 is arcuate in shape and extends between an end 458 and an end 460. In some embodiments, end 458 is configured to apply a force to a portion of pawl 470 to facilitate advancement of indicia 444, as described herein. In some embodiments, surface 454 includes one or a plurality of extensions, such as, for example, latches 462. Latches 462 are configured to facilitate engagement with cap 434, as described herein. Engagement of button 450 and button 452 causes protrusion 456 on button 452 to actuate pawl 470, as described herein.

Figure 18:
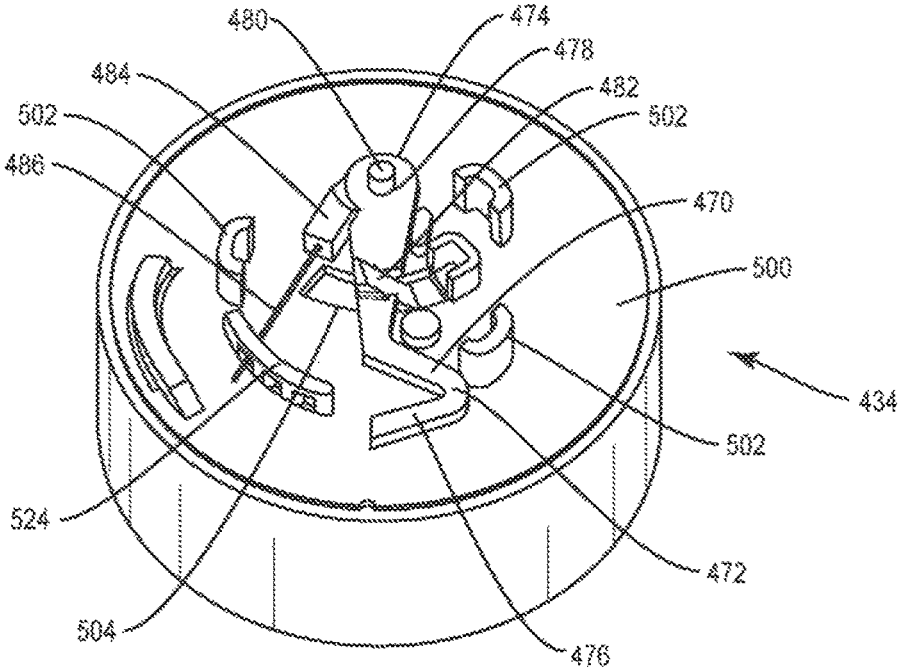
FIG. 18 is a perspective view of components of the system shown in FIG. 16.
Figure 19:
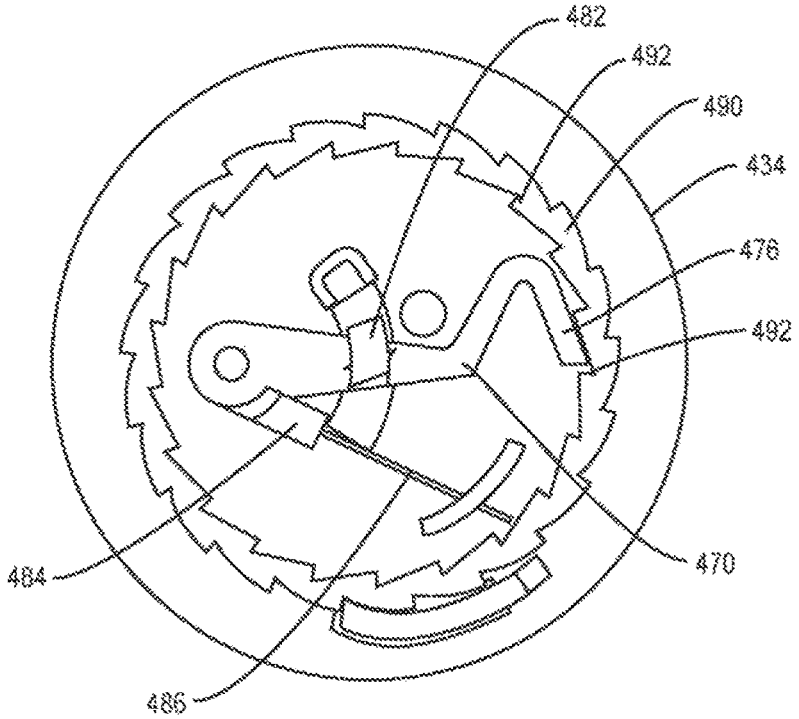
FIG. 19 is a cross section view of components of the system shown in FIG. 16.
Figure 20:
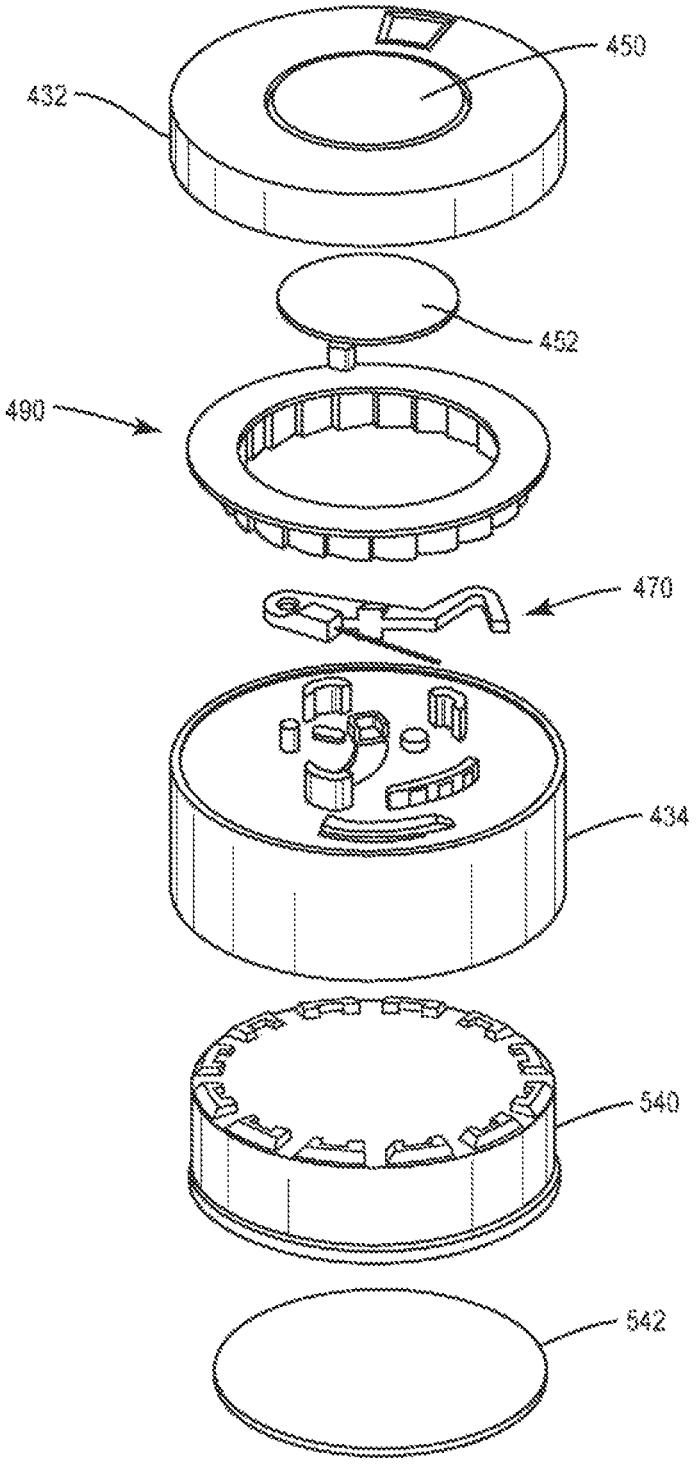
FIG. 20 is an exploded view of components of one embodiment of a system in accordance with the principles of the present disclosure.

Pawl 470 extends between an end 472 and an end 474. End 472 includes a hook 476 configured for engagement with a part, such as, for example, an indicator ring 490. End 474 includes an opening 478 configured for disposal of a pin 480 disposed with cap 434. Pawl 470 is configured for rotation about pin 480 between a first orientation, such as, for example, a start orientation and a second orientation, such as, for example, an advanced orientation. In some embodiments, pawl 470 includes a ramp 482 disposed between ends 472, 474, as shown in FIG. 18. A downward force is applied to ramp 482 causing pawl 470 to rotate. In some embodiments, pin 480 is disposed offset to a center of cap 434 to facilitate mechanical advantage of movement of pawl 470, such as, for example, a downward displacement of approximately 0.09 inches of pawl 470 causes a rotational displacement of approximately 0.16 inches of hook 476. Pawl 470 includes an extension 484. Extension 484 includes a biasing member, such as, for example, a wire spring 486. Spring 486 is configured to facilitate urging pawl 470 back to the start orientation, as described herein.

Indicator ring 490 includes a plurality of teeth 492. Teeth 492 are configured for engagement with hook 476. Rotational movement of pawl 470 causes indicator ring 490 to rotate. Hook 476 engages teeth 492 to facilitate advancement of indicator ring 490 and selectively dispose indicator ring 490 relative to cap 432 to display indicia 444 in the advanced orientation. Spring 486 causes pawl 470 to return to the start orientation.

Cap 434 includes a surface 500. Surface 500 is configured for disposal of pawl 470. Surface 500 includes protrusions, such as, for example, brackets 502. Brackets 502 are configured for engagement with latches 462 to facilitate assembly of button 452 with cap 434. Surface 500 includes an opening, such as, for example, a slot 504. Slot 504 is configured for moveable disposal of ramp 482, as shown in FIG. 18 to facilitate rotation of pawl 470. Surface 502 includes a protrusion, such as, for example, a stop 510. Stop 510 is configured for engagement with a surface of pawl 470 when pawl 470 is in the start orientation. Surface 502 includes a part, such as, for example, a flexible beam 520. Beam 520 is configured to engage indicator ring 490 to resist and/or prevent back-up of indicator ring 490. Surface 500 includes a part 524. Part 524 is configured for disposal of spring 486 such that spring 486 applies a biasing force on pawl 470 to urge pawl 470 into the start orientation, as described herein.

Figure 21:
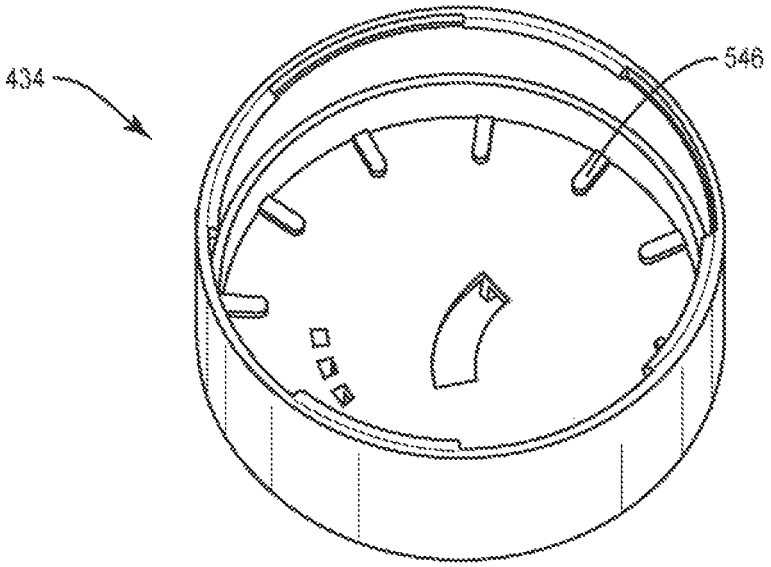
FIG. 21 is a perspective view of components of the system shown in FIG. 20.
Figure 22:
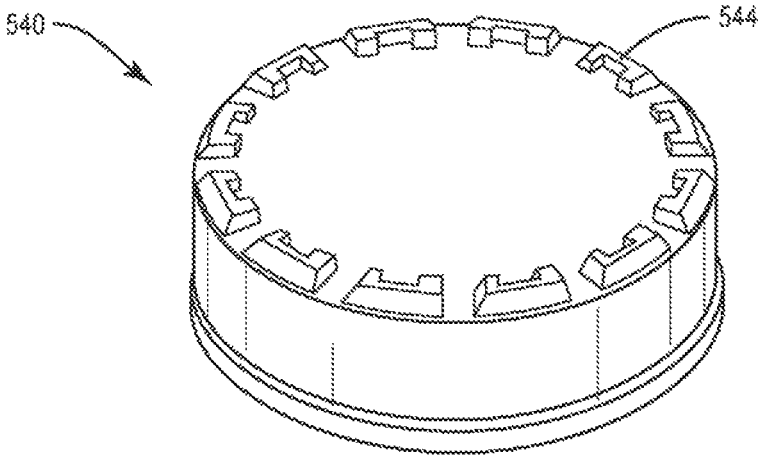
FIG. 22 is a perspective view of components of the system shown in FIG. 20.
Figure 23:
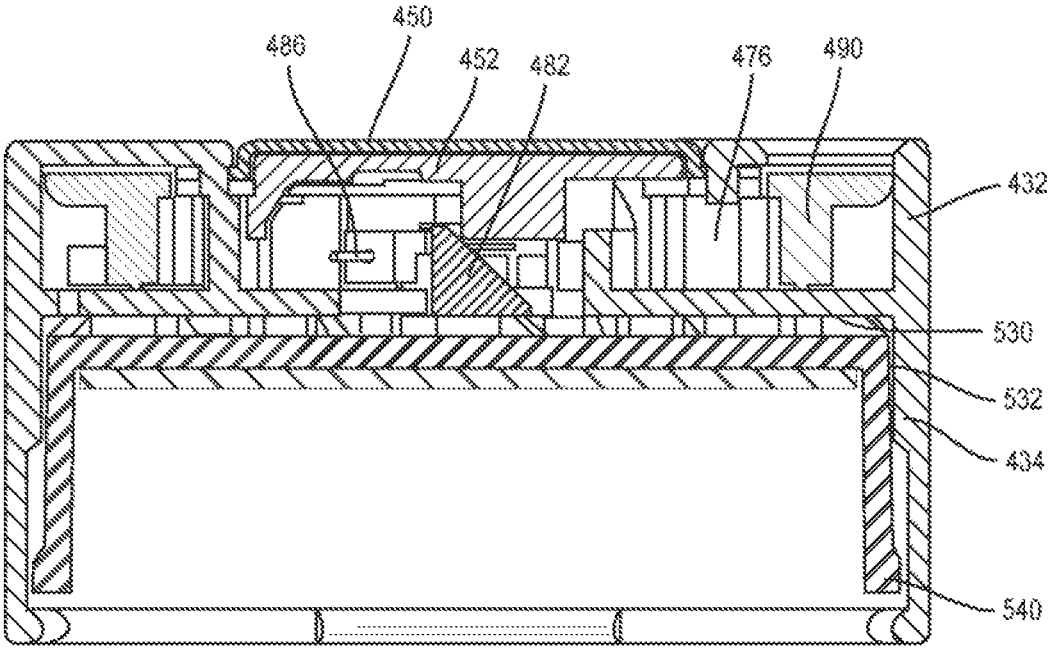
FIG. 23 is a cross section view of components of the system shown in FIG. 20.
Figure 24:
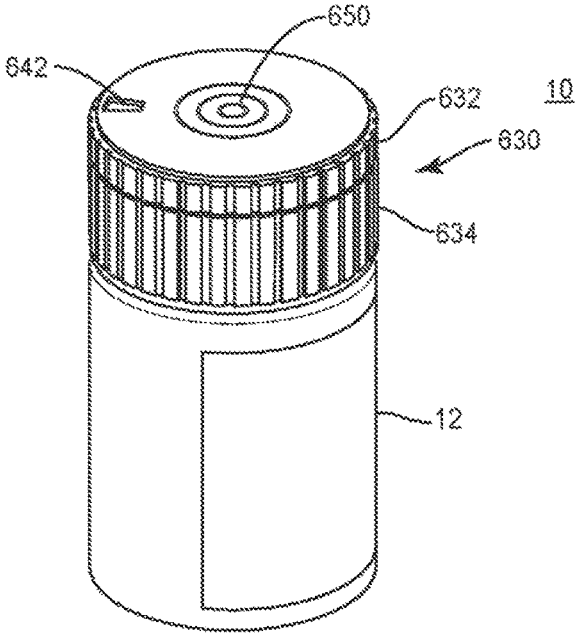
FIG. 24 is a perspective view of components of one embodiment of a system in accordance with the principles of the present disclosure.
Figure 25:
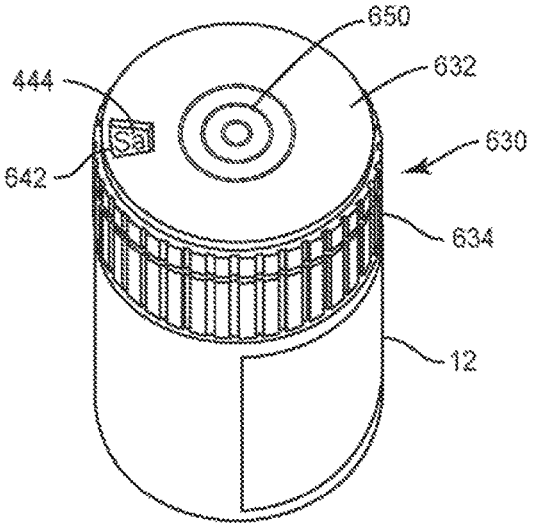
FIG. 25 is a perspective view of components of one embodiment of a system in accordance with the principles of the present disclosure.
Figure 26:
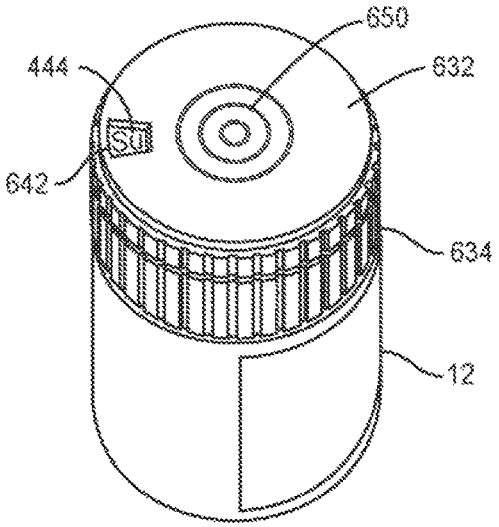
FIG. 26 is a perspective view of components of one embodiment of a system in accordance with the principles of the present disclosure.
Figure 27:
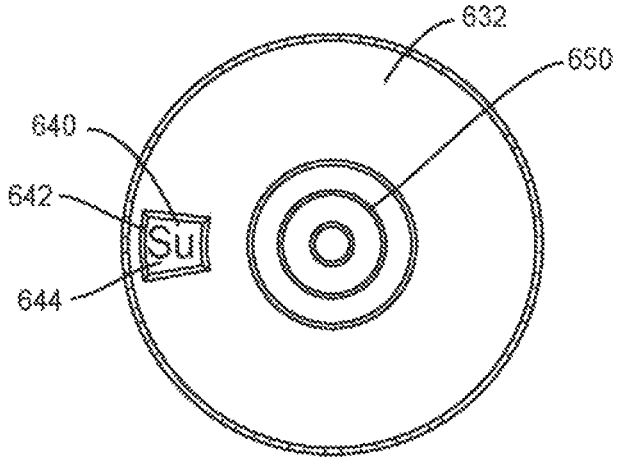
FIG. 27 is a top view of components of one embodiment of a system in accordance with the principles of the present disclosure.
Figure 28:
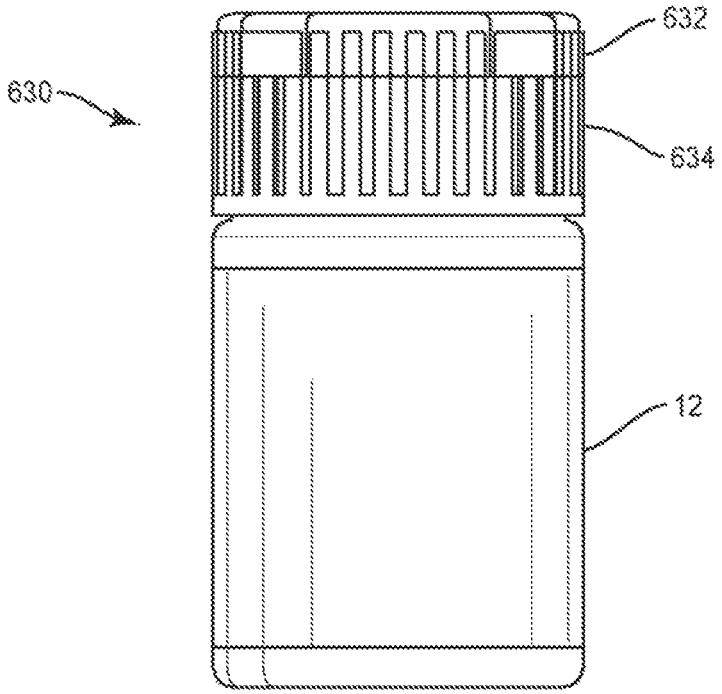
FIG. 28 is a side view of components of one embodiment of a system in accordance with the principles of the present disclosure.

Cap 434 includes a surface 530 that defines a cavity 532. Cavity 532 is configured for disposal of a threaded insert 540 and/or a sealing gasket 542, as shown in FIGS. 21-23. In some embodiments, insert 540 includes an outer surface sized to facilitate a friction fit with the inner surface of cap 434. In some embodiments, insert 540 includes inner threads configured to engage threads 28 of neck portion 24 of bottle 12, as described herein. Gasket 542 is sized to be received by the inner surface of insert 540. In some embodiments, gasket 542 is made from a compressible material such that when brought into contact with neck portion 24, a contacting surface of gasket 542 partially conforms to the shape of neck portion 24.

In some embodiments, cap 434 and insert 540 include child-resistant features 544, 546 to prevent a child from opening medicament dispensing system 10, as shown in FIGS. 21 and 22 and as described herein.

Figure 29:
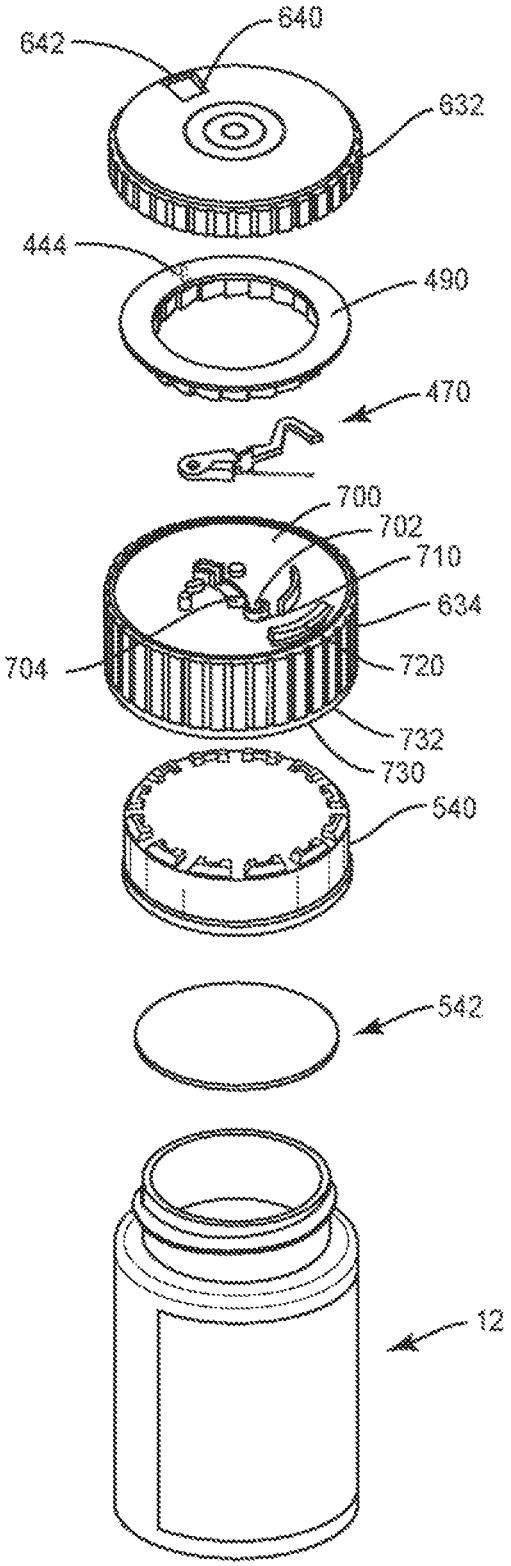
FIG. 29 is an exploded view of components of one embodiment of a system in accordance with the principles of the present disclosure.
Figure 30:
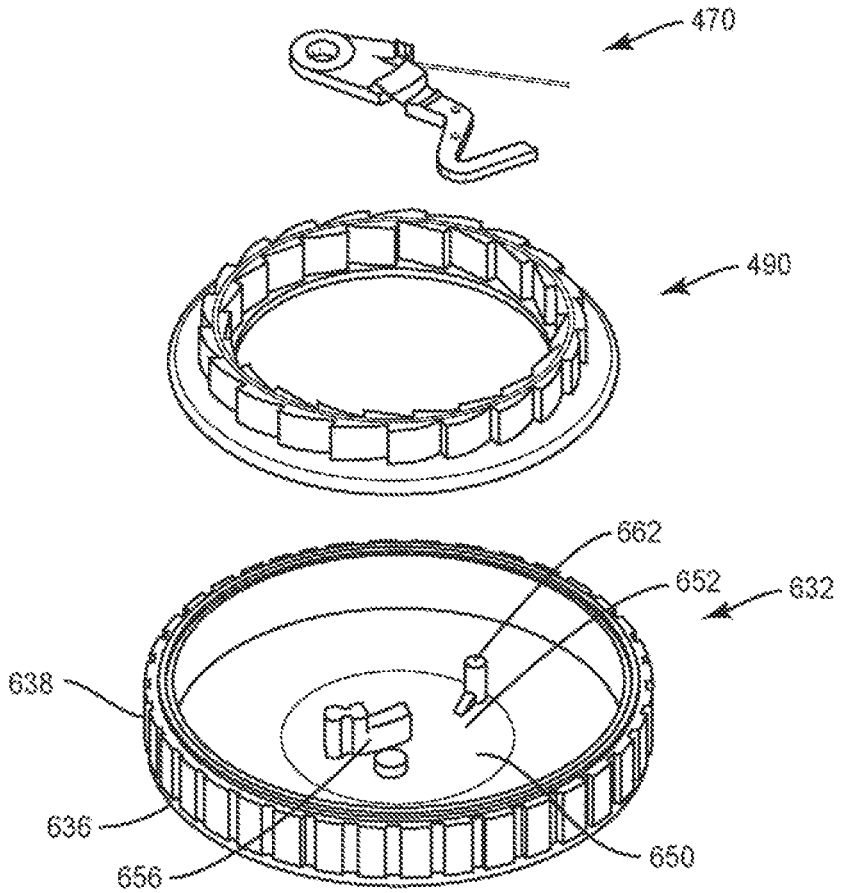
FIG. 30 is an exploded view of components of one embodiment of a system in accordance with the principles of the present disclosure.
Figure 31:
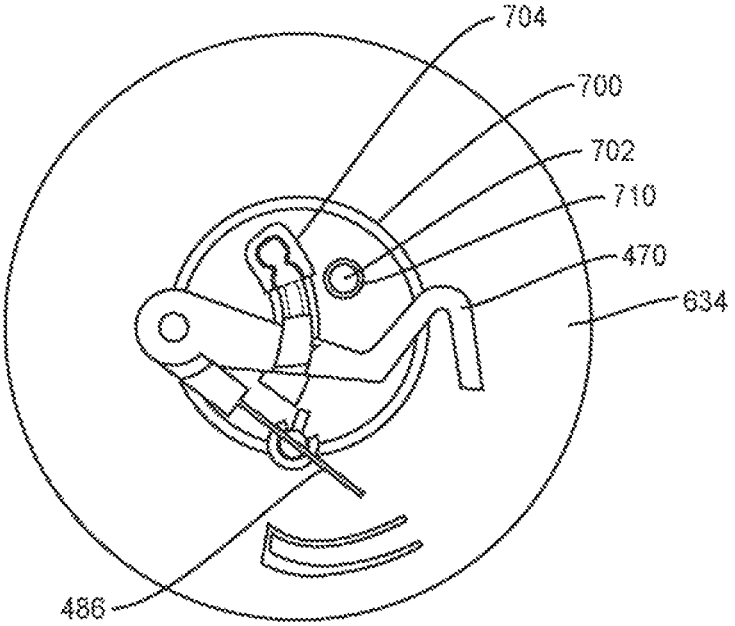
FIG. 31 is a cutaway view of components of one embodiment of a system in accordance with the principles of the present disclosure.
Figure 32:
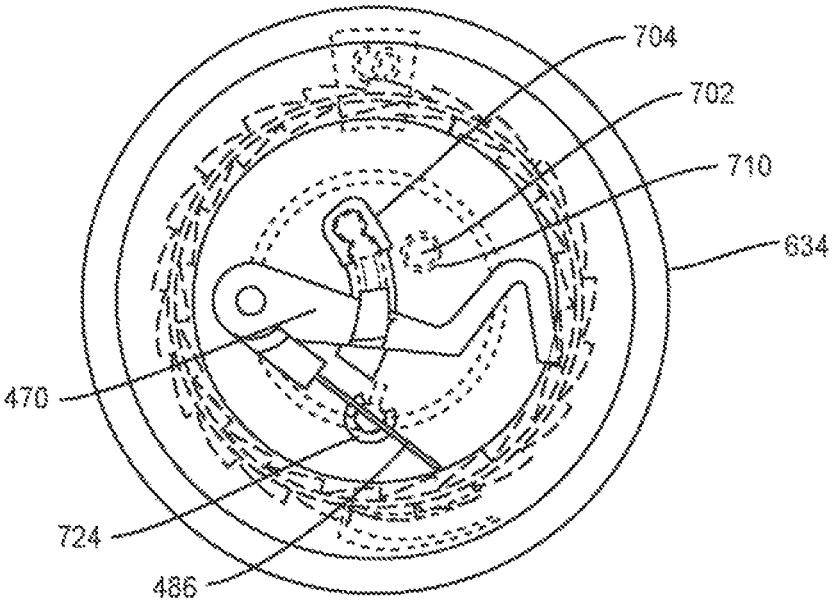
FIG. 32 is a top view, in part phantom, of components of one embodiment of a system in accordance with the principles of the present disclosure.
Figure 33:
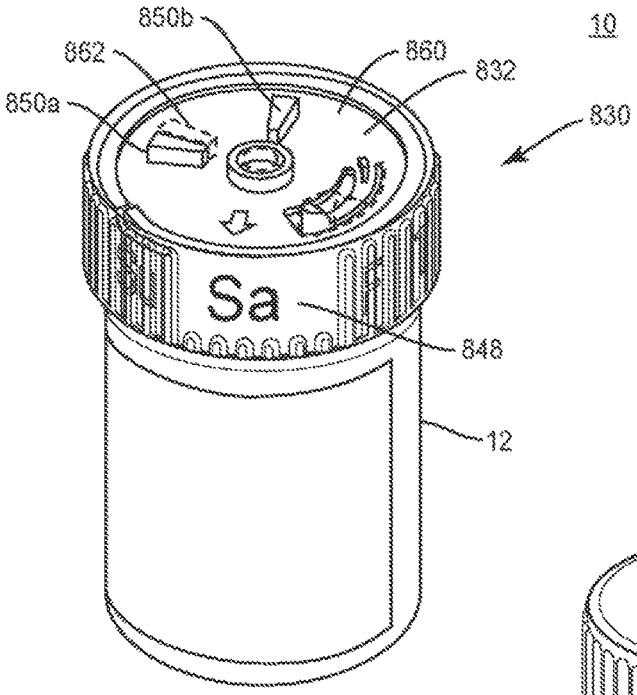
FIG. 33 is a perspective view of components of one embodiment of a system in accordance with the principles of the present disclosure.
Figure 34:
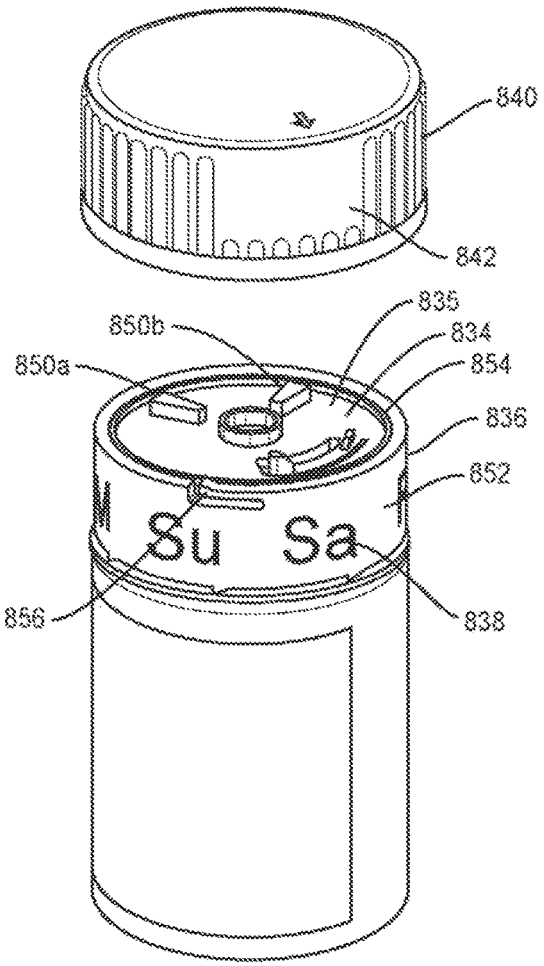
FIG. 34 is a perspective view with parts separated of components of one embodiment of a system in accordance with the principles of the present disclosure.
Figure 35:
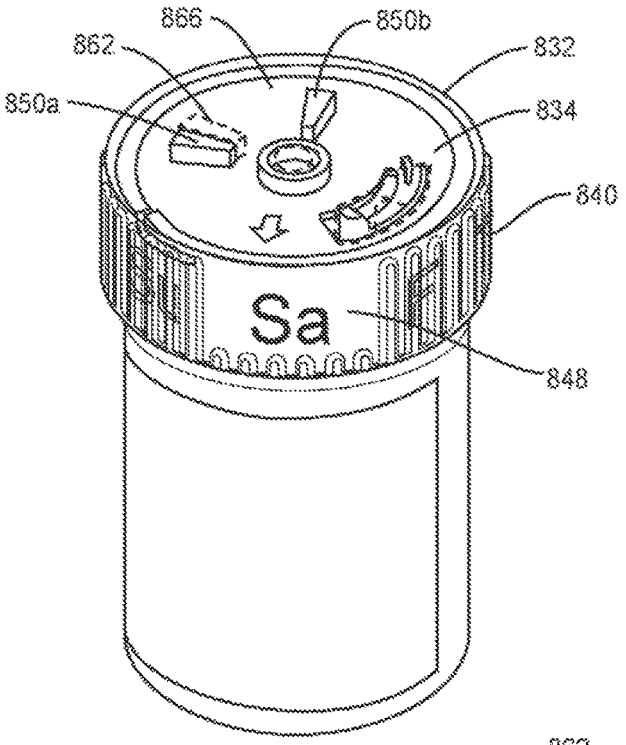
FIG. 35 is a perspective view of components of one embodiment of a system in accordance with the principles of the present disclosure.
Figure 36:
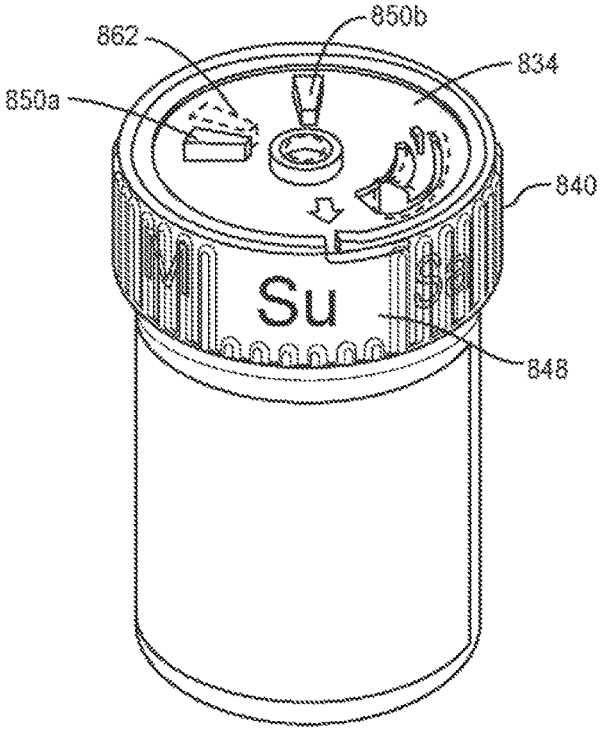
FIG. 36 is a perspective view of components of one embodiment of a system in accordance with the principles of the present disclosure.
Figure 37:
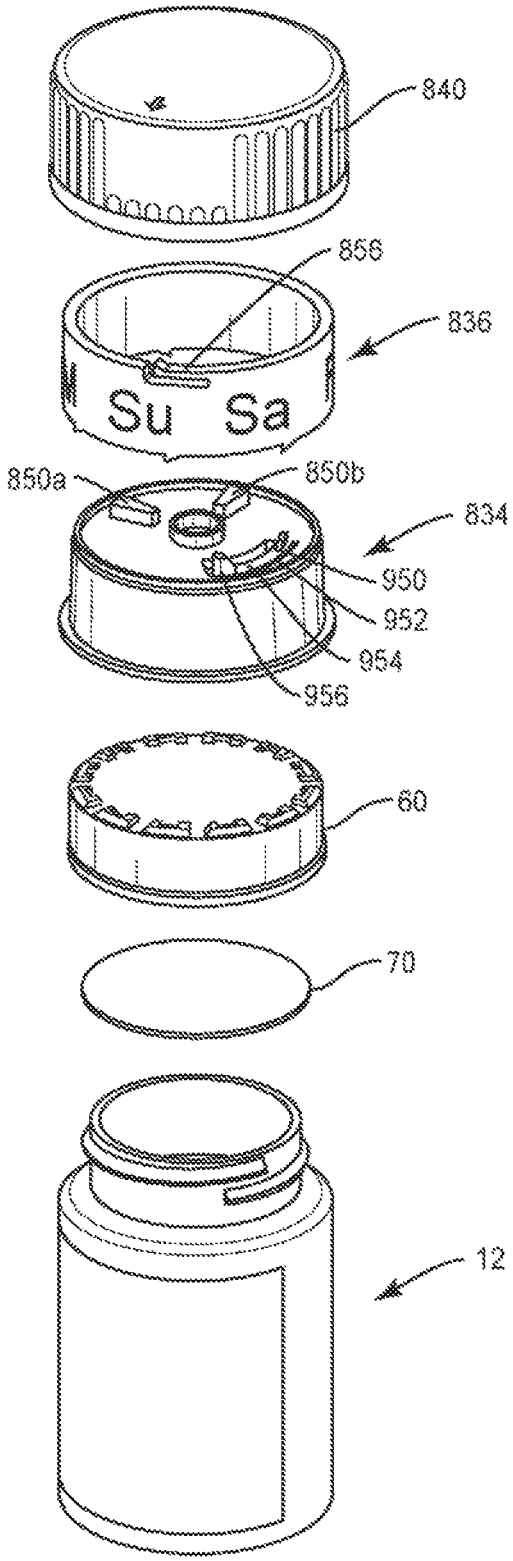
FIG. 37 is an exploded view of components of one embodiment of a system in accordance with the principles of the present disclosure.
Figure 38:
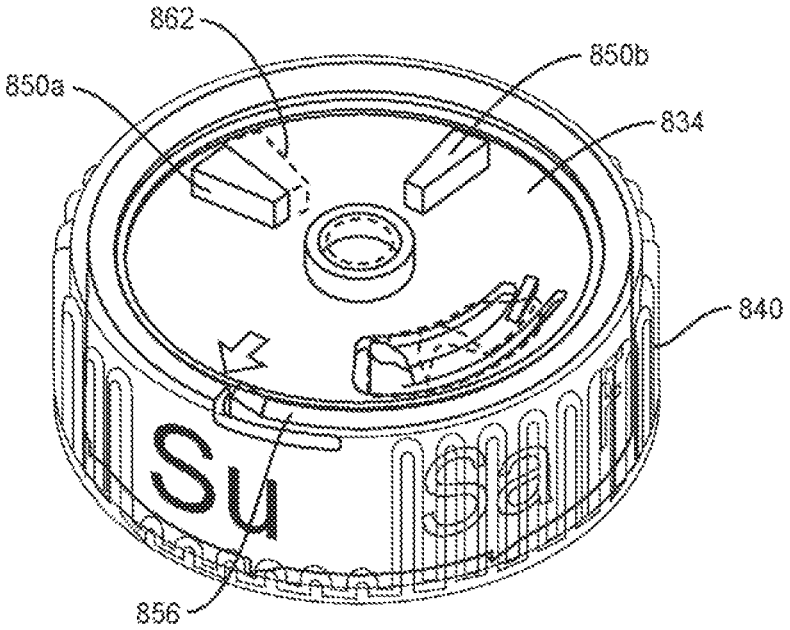
FIG. 38 is an enlarged perspective view of components of the system shown in FIG. 36.
Figure 39:
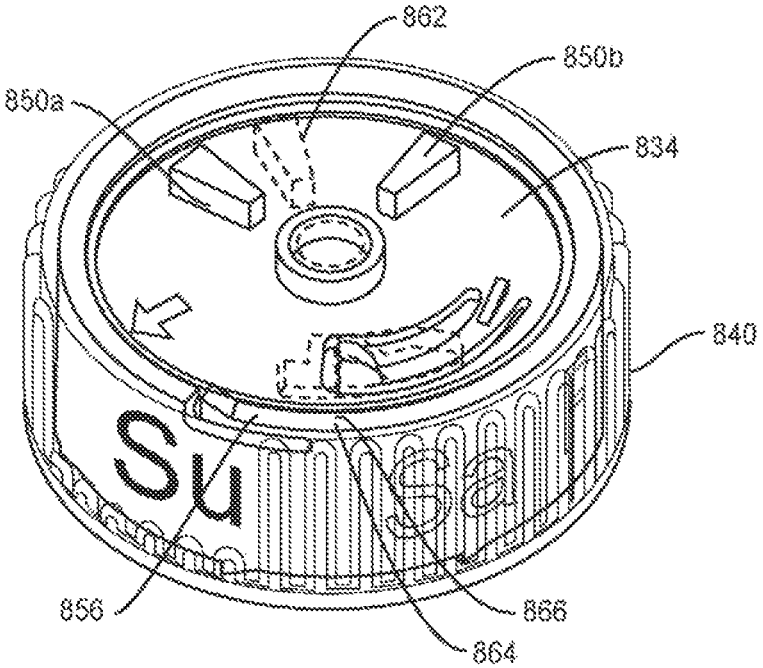
FIG. 39 is an enlarged perspective view of components of the system shown in FIG. 36.
Figure 40:
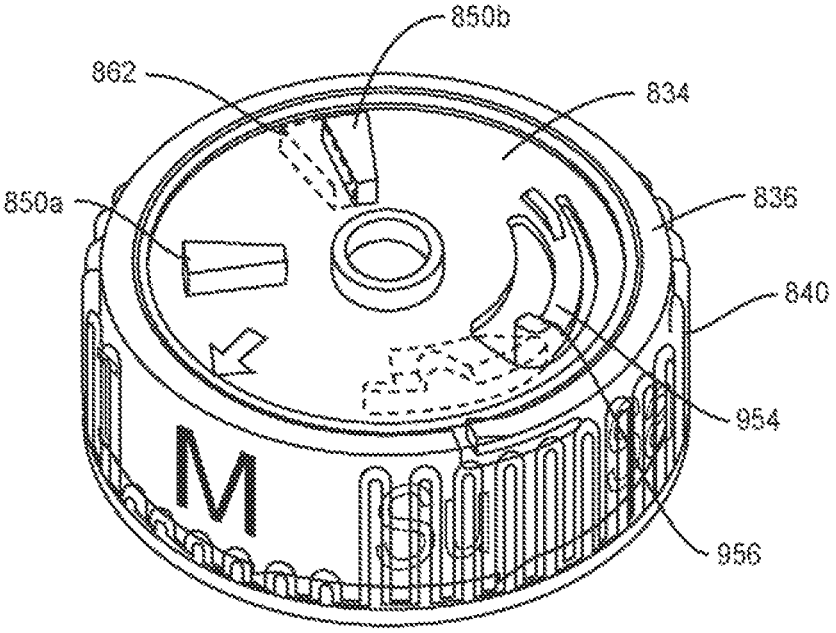
FIG. 40 is an enlarged perspective view of components of the system shown in FIG. 36.
Figure 41:
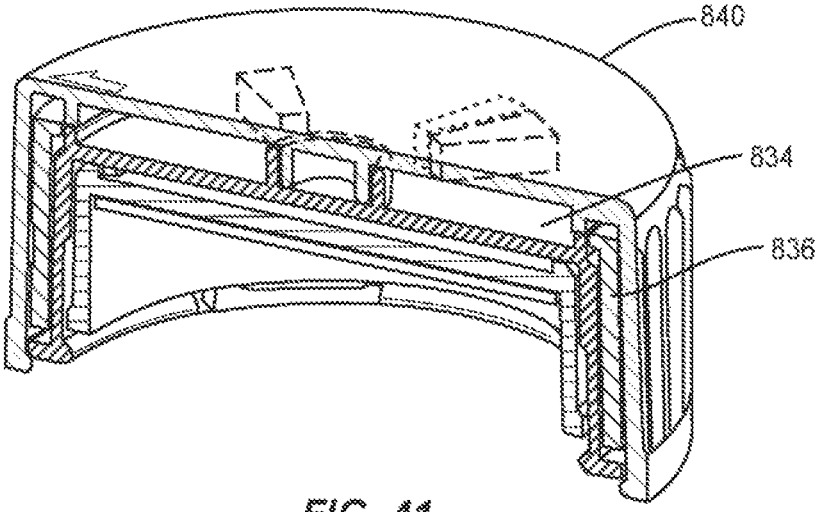
FIG. 41 is a cross section view of the components shown in FIG. 40.
Figure 42:
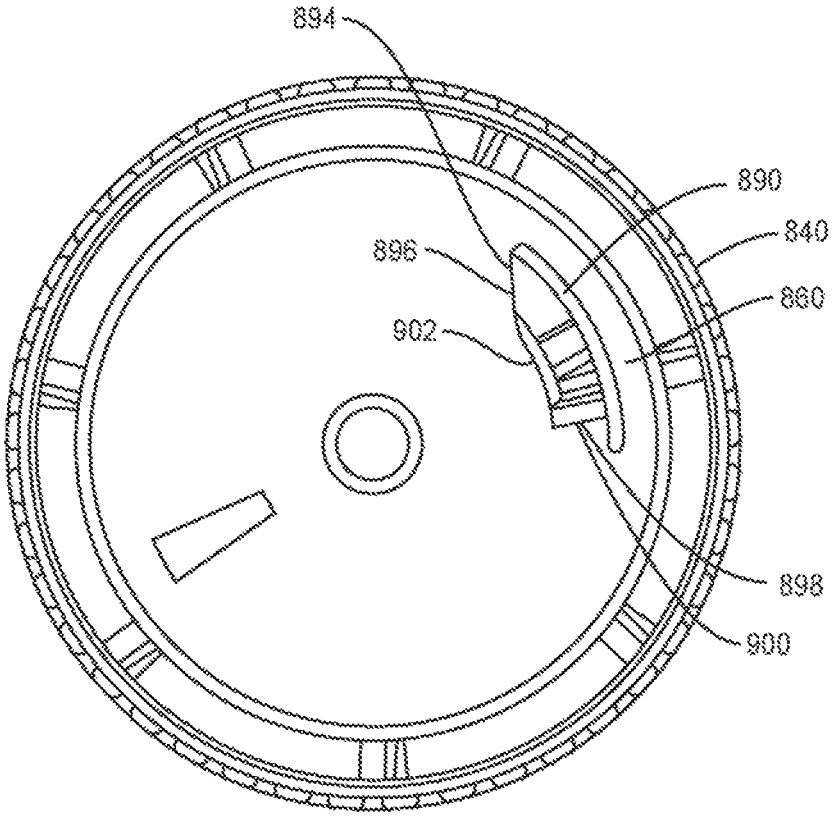
FIG. 42 is a top view of the components shown in FIG. 40.

In one embodiment, as shown in FIGS. 24-32, medicament dispensing system 10, similar to the systems and methods described herein, includes a lid 630, similar to lid 430 described herein. As shown in FIG. 29, lid 630 comprises an upper cap 632 and a lower cap 634, similar to caps 432, 434 described herein.

Cap 632 includes a top 636 and a sidewall 638. Top 636 includes a surface 640 that defines a window 642, similar to the windows described herein, to aid a user in maintaining compliance with a complex dosage regimen. Window 642 is positioned to allow a user to view indicia 444, as described herein. Top 636 includes a button 450. Button 650 is configured to engage an advancement mechanism, such as, for example, pawl 470 described herein. Button 650 includes a surface 652. Surface 652 defines a protrusion 656, similar to protrusion 456 described herein. Protrusion 656 is configured to actuate pawl 470 and indicator ring 490, as described herein. Engagement of button 650 causes protrusion 656 to actuate pawl 470 and indicator ring 490 between a start orientation and an advanced orientation, as described herein. In some embodiments, surface 652 includes one or a plurality of extensions, such as, for example, a latch 662. Latch 662 is configured to facilitate engagement with cap 634, as described herein.

In some embodiments, side wall 638 includes a plurality of gripping ridges radially arrayed about the circumference of sidewall 638. In some embodiments, the ridges project from the surface of sidewall 638 to aid a user in rotating lid 630.

Cap 634 includes a surface 700. Surface 700 is configured for disposal of pawl 470. Surface 700 includes a protrusion, such as, for example, a bracket 702. Bracket 702 is configured for engagement with latch 662 to facilitate assembly of cap 532 and button 650 with cap 634. Surface 700 includes a slot 704, similar to slot 504 described herein. Surface 702 includes a stop 710, similar to stop 510, as described herein. Surface 702 includes a flexible beam 720, similar to beam 520 described herein. Surface 700 includes a part 724. Part 724 is configured for disposal of spring 486 such that spring 486 applies a biasing force on pawl 470 to urge pawl 470 into the start orientation, as described herein.

Cap 634 includes a surface 730 that defines a cavity 732 configured for disposal of threaded insert 540 and/or sealing gasket 542, as described herein. In some embodiments, cap 634 and insert 540 include child-resistant features to prevent a child from opening medicament dispensing system 10, as described herein.

In some embodiments, as shown in FIGS. 33-50, medicament dispensing system 10, similar to the systems and methods described herein, includes a bottle 12 described herein, and a lid 830, similar to lid 330 described herein.

Lid 830 includes an indicator cap 832. Indicator cap 832 includes a cap 834 and a ring 836. Ring 836 is configured for rotation relative to cap 834. In some embodiments, cap 834 includes an inner surface sized to receive threaded insert 60 and/or a sealing gasket 70, as described herein. Cap 834 includes a surface 838. Surface 835 includes one or more ribs, such as, for example, ribs 850*a*, 850*b*. Ribs 850*a*, 850*b* are configured for engagement with a portion of a cap 840, similar to cap 340 described herein. Ribs 850*a*, 850*b* are configured as stops for rotation of cap 834 to advance indicia 838, similar to indicia 338 described herein. In some embodiments, ribs 850*a*, 850*b* comprise a unit of advance and/or increment of indicia for one or more components of a dosage regimen.

Cap 834 includes a surface 950 that defines an opening 952. Cap 834 includes an extension, such as, for example, a flexible arm 954. Arm 954 extends into opening 952. Arm 954 includes an angled portion, such as, for example, a finger 956. A surface of finger 956 is configured for engagement with a surface of cap 840 to provide audible indicia of advancement of lid 830, as described herein. Arm 954 is moveable between a closed orientation, an opened orientation and an advanced orientation, as described herein.

Ring 836 includes an outer surface 852 that includes indicia 838. Indicia 838 are disposed circumferentially about surface 852. Ring 836 includes an opening 854. Opening 854 is configured for disposal of cap 832 such that ribs 850*a*, 850*b* are engageable by cap 840. Ring 836 includes a plurality of protrusions, such as, for example, teeth 856. Teeth 856 are configured for engagement with a portion of cap 840, as described herein. Teeth 856 are positioned about ring 836 such that movement of cap 840 between teeth 856 advances cap 840 a single dose and displays indicia 838.

Cap 840 is configured to aid a user in maintaining compliance with a complex dosage regimen. Cap 840 includes a circumferential sidewall 842 extending from the periphery of a top surface 844. In some embodiments, surface 844 is solid and continuous. Cap 840 includes an inner diameter that is configured to fit snugly over cap 834 and ring 836. In some embodiments, cap 840 allows a user to view indicia 838 to aid a user in complying with a dosage regimen. Cap 840 includes a window 848, similar to window 348 described herein, in sidewall 842 which is sized to align with indicia 838 disposed on ring 836.

In some embodiments, cap 840 includes a surface 860 that defines a rib 862. Rib 862 is configured for engagement with ribs 850*a*, 850*b* to facilitate advancement of indicia 838. Cap 840 includes a surface 864 that includes a protrusion, such as, for example, a tooth 866. Tooth 866 is configured to engage teeth 856 to facilitate incremental rotation of cap 840 relative to ring 836. In some embodiments, cap 840 may include one or more teeth 866.

Cap 840 and ring 836 rotate in unison and/or simultaneously such that rib 862 rotates between ribs 850*a*, 850*b* in a counter-clockwise direction to a limit of travel at rib 850*b*. Rib 862 engages rib 850*b* such that the lid 830 rotates in the counter-clockwise direction and lid 830 is removed from bottle 12. In some embodiments, lid 830 is unthreaded from bottle 12.

Figure 43:
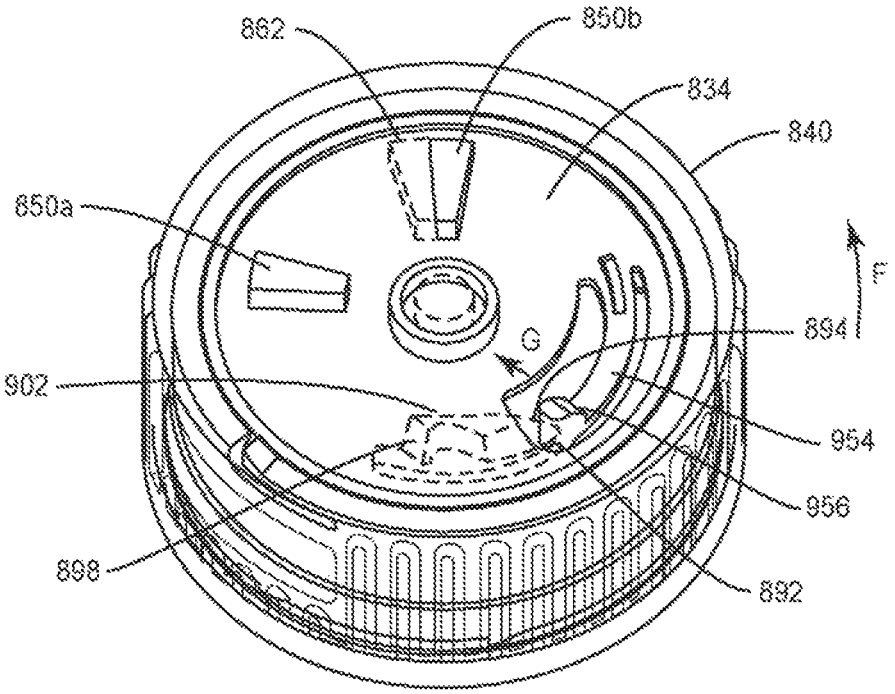
FIG. 43 is a perspective view of components of one embodiment of a system in accordance with the principles of the present disclosure.
Figure 44:
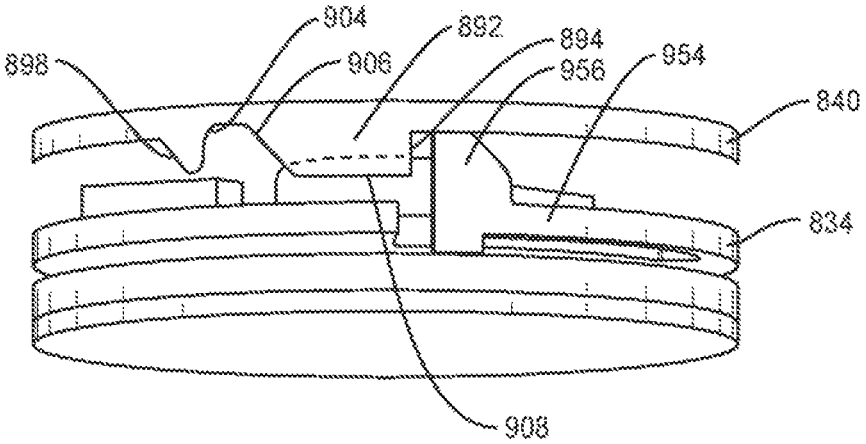
FIG. 44 is a cutaway view of the components shown in FIG. 43.
Figure 45:
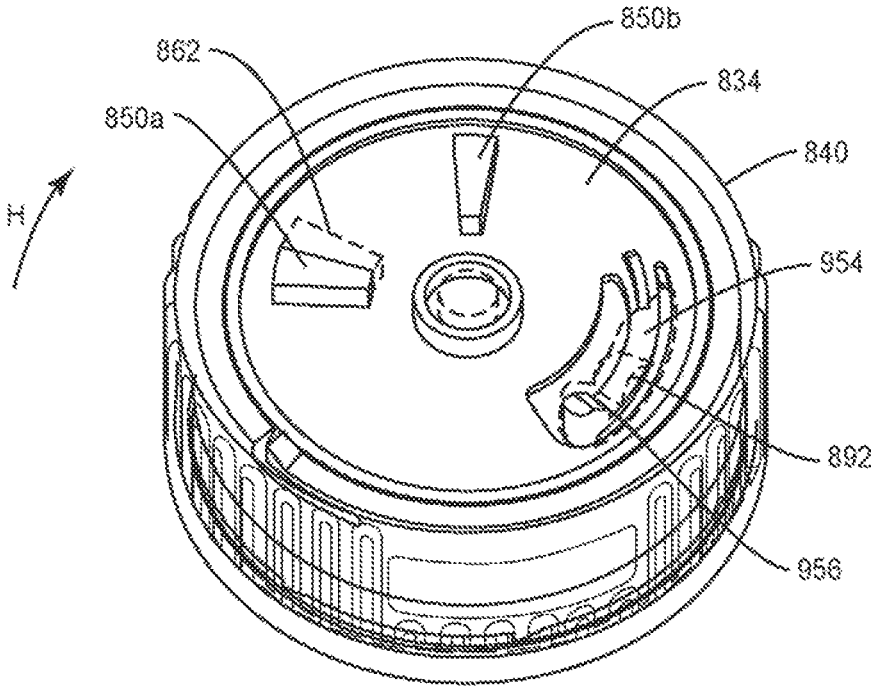
FIG. 45 is a perspective view of components of one embodiment of a system in accordance with the principles of the present disclosure.
Figure 46:
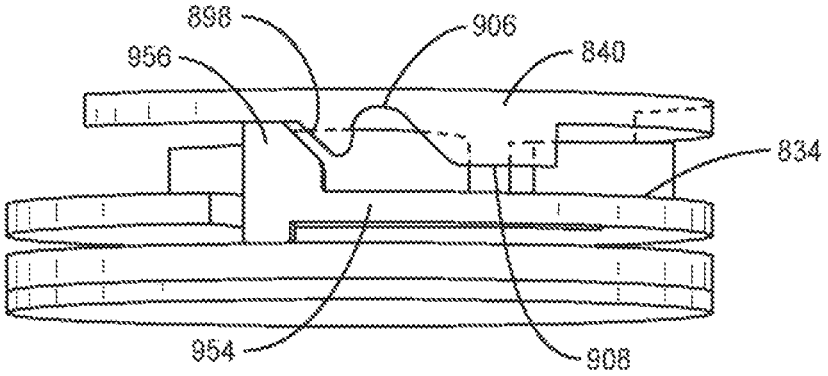
FIG. 46 is a cutaway view of the components shown in FIG. 45.
Figure 47:
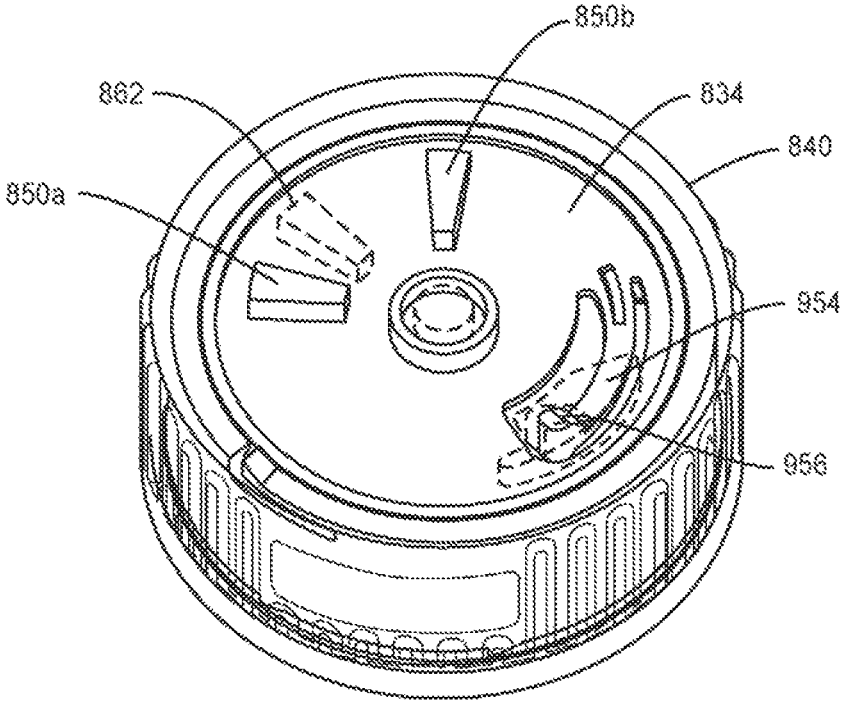
FIG. 47 is a perspective view of components of one embodiment of a system in accordance with the principles of the present disclosure.

In conjunction with ribs 850*a*, 850*b* and rib 363, lid 830 includes a locking element 890 configured to facilitate indication of opening, closing and advancement of lid 830. Locking element 890 includes a lateral ramp 894 having a surface 896 and a lateral ramp 898 having a surface 900. Ramps 894, 898 are connected by a surface 902. Locking element 890 includes a surface 904 that defines a recess 906. In a bottle closed orientation, finger 956 is initially disposed adjacent surface 896 of ramp 894, as shown in FIGS. 43 and 44. To remove lid 830, cap 840 is rotated counter clockwise relative to cap 834, as shown by arrow F in FIG. 43, causing arm 954 to flex inward, as shown by arrow G. Flexing of arm 954 inward allows finger 956 to translate along surface 902. As arm 954 flexes back, finger 956 translates along surface 900 of ramp 898 into a bottle opened orientation such that lid 830 can be removed from bottle 12.

Figure 48:
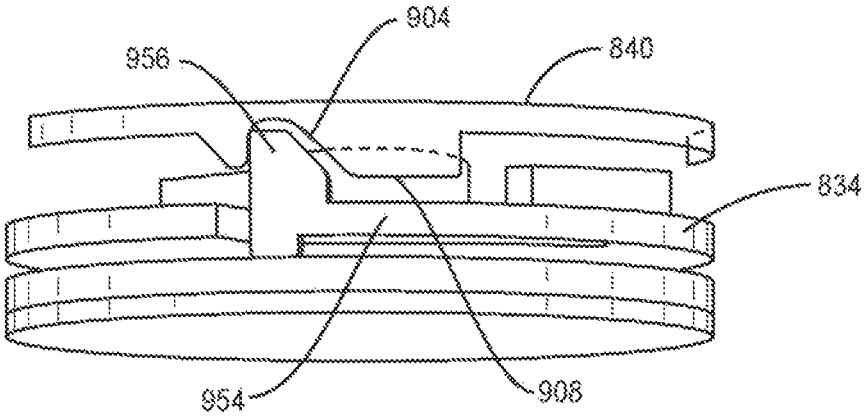
FIG. 48 is a cutaway view of the components shown in FIG. 47.
Figure 49:
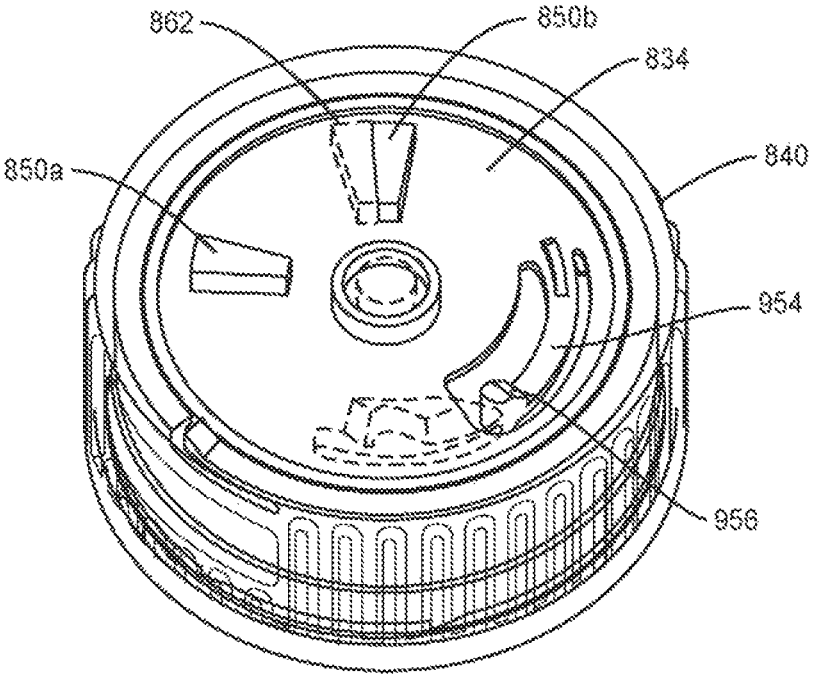
FIG. 49 is a perspective view of components of one embodiment of a system in accordance with the principles of the present disclosure.
Figure 50:
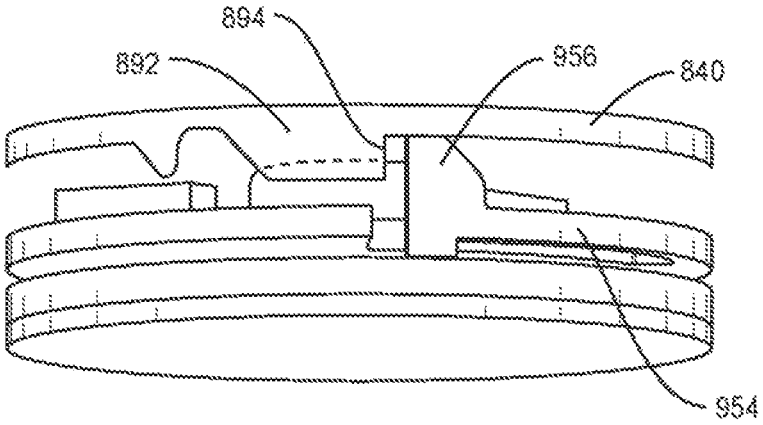
FIG. 50 is a cutaway view of the components shown in FIG. 49.

Lid 830 is replaced by positioning finger 956 adjacent ramp 898. Lid 830 is rotated clockwise, as shown by arrow H in FIG. 45, causing finger 956 to translate over ramp 898 into recess 906, as shown in FIG. 48, into a bottle closed orientation. In some embodiments, translation of finger 956 over ramp 898 causes a tactile click. In some embodiments, translation of finger 956 over ramp 898 causes an audible click. Lid 830 is further rotated clockwise such that finger 956 translates out of recess 906 along a surface 908 into a position adjacent ramp 894, returning to a bottle advanced and closed orientation. In some embodiments, translation of finger 956 over surface 908 and onto ramp 894 causes a tactile click. In some embodiments, translation of finger 956 over surface 908 and onto ramp 894 causes an audible click.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. Medication packaging comprising:

a body defining a cavity for disposal of medication; and a closure member disposed with the body, the closure member including an advancement mechanism and a window that displays indicia of a medication dosage regimen, wherein the closure member is rotatable between a medication accessible configuration and a closed configuration that;

the advancement mechanism comprising a pawl extending radially from an off-center pivot location on the closure member, wherein a downward oriented force on a ramped surface associated with the pawl provides a horizontal component of force that causes a rotational movement of the pawl, wherein the rotational movement of the pawl causes an incremental advancement of the indicia.

2. Medication packaging as recited in claim 1, wherein the the pawl rotates about a pin disposed between an outer cap and an inner cap of the closure member.

3. Medication packaging as recited in claim 1, wherein the the pawl engages a tooth of an indicator ring bearing the indicia.

4. Medication packaging as recited in claim 3, wherein the pawl extends radially inward from the off-center pivot location, wherein the tooth engaged by the pawl is further from the off-center pivot location than a center of the closure member.

5. Medication packaging as recited in claim 1, wherein the downward force is provided when a user presses down on a portion of the closure member, wherein the downward force is required to bypass child resistant features of the medication packaging and to allow the medication packaging to be opened.

6. Medication packaging as recited in claim 1, wherein the downward force is provided via a button extending through a lid portion of the closure member.

7. Medication packaging as recited in claim 1, further comprising a biasing member coupled to the pawl, the biasing member configured to urge the pawl back toward a start orientation.

8. Medication packaging as recited in claim 1, wherein the closure member includes a cavity configured for disposal of a sealing gasket.

9. Medication packaging as recited in claim 1, wherein the closure member includes a clear outer cap disposed with an indicator cap, the clear outer cap including a window for viewing the indicia on the indicator cap, wherein the rotational movement of the pawl causes rotational movement of the indicator cap to effect the incremental advancement of the indicia.

10. Medication packaging as recited in claim 9, wherein the window is sized to align with the indicia.

11. Medication packaging as recited in claim 1, wherein the closure member includes an indicator configured to direct a user to the indicia.

12. Medication packaging as recited in claim 1, wherein the closure member includes ridges configured to facilitate gripping and opening.

13. Medication packaging as recited in claim 1, wherein the advancement mechanism includes a ratchet wheel for engagement with the pawl.

14. Medication packaging as recited in claim 1, wherein the advancement mechanism includes a stopping mechanism configured to facilitate incremental advancement of the indicia.

15. Medication packaging as recited in claim 1, wherein the advancement mechanism includes a spring configured to urge rotation of components of the closure member.

16. Medication packaging as recited in claim 1, wherein the body includes an oblong configuration.

17. Medication packaging as recited in claim 1, wherein the closure member includes a first gripping portion and a second gripping portion.

18. Medication packaging as recited in claim 1, wherein the advancement mechanism includes a button.

19. A medical compliance method for a discharged patient, the method comprising the steps of:

treating a patient for an illness;

reviewing a medical therapy for treating the illness, the medical therapy comprising a medical regimen that includes at least one dose of at least one medication; and providing medication packaging according to claim 1.

* * * * *